US008267401B2

(12) United States Patent
Nakajima

(10) Patent No.: US 8,267,401 B2
(45) Date of Patent: Sep. 18, 2012

(54) RECORDING APPARATUS AND TRANSPORTING CONTROL METHOD IN RECORDING APPARATUS

(75) Inventor: Norihiko Nakajima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 12/748,991

(22) Filed: Mar. 29, 2010

(65) Prior Publication Data

US 2010/0252986 A1 Oct. 7, 2010

(30) Foreign Application Priority Data

Apr. 1, 2009 (JP) ..... 2009-089614

(51) Int. Cl.
*B65H 7/02* (2006.01)

(52) U.S. Cl. ..... 271/265.01; 271/3.14; 271/258.01

(58) Field of Classification Search ..... 271/265.01, 271/3.14, 258.01
See application file for complete search history.

(56) References Cited

U.S. PATENT DOCUMENTS

| | | | | |
|---|---|---|---|---|
| 4,114,028 | A * | 9/1978 | Baio et al. | 235/458 |
| 4,451,854 | A * | 5/1984 | Daigo | 358/480 |
| 4,833,722 | A * | 5/1989 | Morton et al. | 382/199 |

FOREIGN PATENT DOCUMENTS

| | | | |
|---|---|---|---|
| JP | 1-156087 | A | 6/1989 |
| JP | 7-69480 | A | 3/1995 |
| JP | 2002-292949 | A | 10/2002 |
| JP | 2007-191285 | A | 8/2007 |

* cited by examiner

*Primary Examiner* — Michael McCullough
*Assistant Examiner* — Howard Sanders
(74) *Attorney, Agent, or Firm* — Global IP Counselors, LLP

(57) ABSTRACT

Provided is a recording apparatus for performing recording on a medium, including: a transporting unit which transports the medium; a recording unit which performs the recording on the transported medium; a control unit which controls the transporting unit and the recording unit; and a detection unit which detects presence or absence of the medium at a predetermined position in a transporting path, wherein, during or after the transporting of the medium, after the detection unit detects medium absence if the detection unit detects medium presence during an interval until the transporting for a regulated distance, which is set as a value of a diameter or more of a hole provided to the medium, is finished, the control unit determines erroneous operation and performs a predetermined process so as to remove the erroneous operation state.

7 Claims, 11 Drawing Sheets

RECORDING APPARATUS AND TRANSPORTING CONTROL METHOD IN RECORDING APPARATUS

CROSS-REFERENCE TO RELATED APPLICATIONS

This application claims priority to Japanese Patent Application No. 2009-089614 filed on Apr. 1, 2009. The entire disclosure of Japanese Patent Application No. 2009-089614 is hereby incorporated herein by reference.

BACKGROUND

1. Technical Field

The present invention relates to a recording apparatus capable of distinguishing an end of a perforated medium from a hole of the perforated medium and detecting the end and a transporting control method in the recording apparatus.

2. Related Art

For example, JP-A-2002-292949 discloses a printer where a sheet detection sensor can detect an end of a perforated sheet without erroneous detection of a hole (filling hole) of the perforated sheet. The printer includes a sensor (detection unit) for detecting whether or not a predetermined position of the sheet in the transporting path is covered with the sheet. In addition, sheet absence is detected by the sensor, and after the detection of the sheet absence by the sensor continues to be performed until the sheet is transported by a regulated distance that is a distance of a diameter of the hole or more provided to the sheet, it is recognized that the end of the sheet reaches a position (printable limit position) where is separated from the predetermined position by a regulated distance in a predetermined direction. In addition, in a necessary case, the printing is allowed to stop. Herein, the regulated distance of the diameter of the hole or more is set to a printable maximum length (that is, a distance (so-called override amount) until the end of the sheet detected by the sensor reaches the position (printable limit position) where a printing control process is to be stopped) after the lower end of the sheet (the end of the sheet) is located under the sensor. As a result, even in the case of using the perforated sheet, the problem in that the hole is erroneously determined so that ink may be ejected on a platen can be prevented.

In addition, JP-A-1-156087 discloses a configuration of a printer apparatus where, at the time of supplying power to the printer apparatus or at the time of resetting, presence or absence of a printing sheet (medium) is detected at a predetermined position by a photosensor (detection unit), in the case where the printing sheet absence is determined, the sheet is moved by a predetermined distance that is obtained by adding $\alpha$ (>0) to a diameter D of a filling hole, and in the case where the printing sheet absence is determined at a predetermined position with respect to the moved printing sheet, a sheet end signal indicating an end of the sheet is output. In addition, at the time of supplying power to the printer apparatus or at the time of resetting, even in the case where the printing sheet absence is determined based on detection of the filling hole by the photosensor, if the printing sheet presence is determined after the movement for a predetermined distance ($D+\alpha$), the sheet presence can be recognized only by the detection of the filling hole. In this case, the printing sheet is allowed to return to an original position only by the predetermined distance ($D+\alpha$).

However, according to the technology disclosed in JP-A-2002-292949, if the sensor detects the sheet absence, the measuring unit is allowed to start the measurement, and if the hole is detected, since the sheet presence is detected, the printing control process is not allowed to stop. Next, although the measuring unit is allowed to start the measurement when the sheet absence is detected again, the previously starting measurement of the measuring unit continues to be performed without stop of the measurement until the sheet absence is detected again. For example, in the case of a sheet, of which a hole pitch is relatively wide, during the time interval where the transporting for a relatively long distance corresponding to the wide hole pitch is performed, the measurement of the measuring unit continues to be performed.

For example, in a printer where transporting control is changed based on a measured value of a measuring unit that measures a transporting distance from a position of a sheet when the end (lower end) of the sheet is detected, the measurement of the measuring unit that is allowed to start by the detection of the hole continues to be performed until the sheet reaches a position where the transporting control is changed. In this case, irrespective of the detection of the hole of the sheet by the sensor, the transporting control is changed, so that an erroneous operation in the transporting control may occur.

In addition, in the case where the sheet is discharged, after the discharging operation for the distance which can be discharged to a stacker, if the detection state of the detection unit (sensor) is the sheet absence, it is determined that the sheet is determined to be correctly discharged. On the other hand, if the detection state is the sheet presence, it is determined that the sheet remains, and the discharging operation for a predetermined amount is repeated until the detection state of the sensor is the sheet absence, so that the sheet can be securely discharged.

In the printer apparatus disclosed in JP-A-1-156087, at the time of supplying power or at the time of resetting, the presence or absence of the sheet can be accurately determined. However, in the case where a sheet which is longer than a set size is set, after the discharging operation of the sheet, if the photosensor incidentally detect the filling hole, even through the sheet remains actually, it is erroneously determined that the sheet is discharged. For example, the discharging operation where the sheet is transported by the discharging amount necessary for the discharging that is determined based on the set size may be determined to a normal operation in the case where the discharging operation is performed according to the sheet absence based on the passing of the end of the sheet through the predetermined position, but it may be an erroneous operation where the sheet cannot be discharged to the stacker in the case where the discharging operation is performed according to the sheet absence based on the detection of the hole. In this manner, in the case where the discharging operation that becomes the erroneous operation is performed, the sheet is in a state where the sheet is nipped by, for example, a discharging roller. In this case, a user forcibly extracts the sheet, which may leads to a tear of the sheet.

In this manner, there is a problem in that it is difficult to appropriately remove an erroneous operation state where even a normal operation in the case where the detection of the sheet absence is based on the passing of the end of the sheet through a predetermined position may become an erroneous operation in the case where the detection of the sheet absence is based on the detection of the hole (for example, an erroneous operation of the measuring unit that is allowed to start the measuring process according to the detection of the hole or an erroneous operation that is performed by an erroneous discharging distance that does not match with an actual sheet size).

SUMMARY

An advantage of some aspects of the invention is to provide a recording apparatus capable of appropriately removing an erroneous operation state, wherein in the case where a detection unit detects medium absence based on passing of an end of the medium through a predetermined position, an erroneous operation may occurs if the detection unit detects the hole as the medium absence, and a transporting control method in the recording apparatus.

According to an aspect of the invention, there is provided a recording apparatus for performing recording on a medium, including: a transporting unit which transports the medium; a recording unit which performs the recording on the transported medium; a control unit which controls the transporting unit and the recording unit; and a detection unit which detects presence or absence of the medium at a predetermined position in a transporting path, wherein, during or after the transporting of the medium, after the detection unit detects medium absence if the detection unit detects the medium presence during an interval until the transporting for a regulated distance, which is set as a value of a diameter or more of a hole provided to the medium, is finished, the control unit performs a predetermined process so as to remove an erroneous operation state, where even a normal operation, in the case where the detection of the medium absence is based on passing of the end of the medium through a predetermined position, becomes an erroneous operation in the case where the detection of the medium absence is based on detection of the hole; if the transporting for the regulated distance is finished without detection of the medium presence by the detection unit during the transporting for regulated distance, the control unit does not perform the predetermined process; and in the case where the predetermined process is performed, during or after the transporting, if the detection unit detects the medium absence, the control unit repeats the transporting for the regulated distance and the predetermined process, which is to be performed when the detection unit detects the medium presence during the transporting for the regulated distance, until the transporting is finished without detection of the medium presence by the detection unit during the transporting for the regulated distance.

According to the above aspect of the invention, during or after the transporting of the medium, after the detection unit detects medium absence, if the detection unit detects the medium presence during an interval until the transporting for a regulated distance, which is set as a value of a diameter or more of a hole (for example, a filling hole or the like) provided to the medium, is further performed, a predetermined process is performed to remove an erroneous operation state where an operation that is performed based on the detection of the medium absence is a normal operation in the case where the detection of the sheet absence is based on the passing of the end of the medium through the predetermined position but it becomes an erroneous operation in the case where the detection of the sheet absence is based on the detection of the hole. On the other hand, in the case where the transporting for the regulated distance is finished without detection of the medium presence by the detection unit during the transporting, the predetermined process is not performed. In addition, in the case where the predetermined process is performed, during or after the transporting of the medium after the predetermined process, when the detection unit detects the medium absence, the transporting for the regulated distance and the predetermined process which is to be performed when the detection unit detects the medium presence during the transporting for the regulated distance are repeated until the transporting for the regulated distance is finished without detection of the medium presence by the detection unit during the transporting for the regulated distance. Accordingly, it is possible to appropriately remove an erroneous operation state where even a normal operation in the case where the detection of the sheet absence by the detection unit is based on the passing of the end of the sheet through a predetermined position may become an erroneous operation in the case where the detection of the sheet absence of the detection unit is based on the detection of the hole.

In the above recording apparatus, the detection unit may be configured to detect the presence or absence of the medium at the predetermined position at the upstream side in the transport direction from the recording position of the recording unit, and wherein the control unit includes a measuring unit which performs a measuring process for measuring a second regulated distance from a position where the end of the medium passes through the predetermined position to a position where the medium reaches a recording limit position where the recording of the recording unit can be performed, wherein the regulated distance is set to a value that is less than the second regulated distance, wherein if the detection unit detects the medium absence, the performance of the measuring process of the measuring unit is temporarily suspended, wherein if the detection unit detects the medium presence during the time interval from the time when the medium absence is detected to the time when the transporting for the regulated distance is finished, a canceling process of canceling the performance of the measuring process of the measuring unit that is suspended as the predetermined process is performed, and wherein if the transporting for the regulated distance is finished without detection of the medium presence by the detection unit, the measuring process of the measuring unit that is suspended is allowed to be performed based on a value where the suspended transporting amount is reflected.

According to the above invention, if the detection unit detects the medium absence, the performance of the measuring process of the measuring unit is temporarily suspended, and if the detection unit detects the medium presence during the time interval from the time when the medium absence is detected to the time when the transporting for the regulated distance is finished, the performance of the suspended measuring process of the measuring unit is cancelled. On the other hand, if the transporting for the regulated distance is finished without detection of the medium presence by the detection unit, the suspended measuring process of the measuring unit is allowed to be performed based on a value where the suspend transporting amount is reflected. As a result, the measuring unit is allowed to start the measurement of the second regulated distance from the predetermined position to the recording limit position based on a value, where the suspended transporting amount is reflected, from the time when the performance is allowed due to the release of the suspension. Therefore, in the case where the medium absence is based on the detection of the hole by the detection unit, the measuring process of the measuring unit is suspended and is not allowed to start, and after that, at the time where the detection unit detects the medium presence before the transporting for the distance of the hole diameter is completed, the suspended measuring process is cancel without performing thereof. Accordingly, an erroneous operation that is caused by the performance of the measuring process of the measuring unit, for example, an erroneous operation of the recording apparatus can be more securely avoided. On the other hand, the measuring process of the measuring unit, which is suspended when the medium absence is detected due to the passing of the end of the medium by the detection unit through a predetermined position, is allowed to start with a value, where the suspended transporting amount (regulated distance) is reflected, at the time when the transporting for the regulated distance(<second regulated distance) is finished, and thus, the control unit recognizes based on the measured value of the measuring unit that the end of the medium reaches the recording limit position. In addition, since a hole diameter or a value or more, which is obtained by adding a small margin to the hole diameter, may become a sufficient regulated distance as a minimum value, a distance that is much smaller than the second regulated distance may be set as the regulated distance.

In the above recording apparatus, if the measuring unit finishes the measurement of the second regulated distance, the control unit may control the recording unit and the transporting unit to forcibly finish the recording operation of the recording unit and to discharge the medium by the transporting unit.

According to the above invention, if the measuring unit completely measures the second regulated distance, the control unit forcibly stops the recording operation of the recording unit and controls the transporting unit to discharge the medium. Therefore, the performance of the measuring process, which is suspended due to the medium absence that is based on the detection of the hole by the detection unit, can be cancelled speedily at the time when the detection unit detects the medium presence I before the transporting for the distance of the hole diameter is finished. In addition, the measuring process of the measuring unit, which is suspended when the detection unit detects the medium absence due to the passing of the end of the sheet through a predetermined position, can be allowed to start with a value, where the suspended transporting amount (regulated distance) is reflected, at the time when the transporting for the regulated distance (<second regulated distance) is finished. Accordingly, when the end of the medium reaches the recording limit position, the recording operation of the recording unit is forcibly stopped, so that it is possible to avoid a problem in that recording is performed on a portion excluding the medium (for example, a platen or the like).

In the above recording apparatus, the transporting unit may include transport roller pairs at a position of the uppermost streamside and a position of the downstream side in the transporting path with the recording unit disposed therebetween, wherein a setting unit, which set the regulated distance to a value smaller than a distance from the predetermined position to the transporting roller pair of the upstream side in the transporting path, is further included, and wherein, if it is determined based on the measured value of the measuring unit that the medium is in a first section where the medium is transported by the two transport roller pairs of the upstream side and the downstream side, the control unit controls the transporting unit in first transporting control, and if it is determined that the medium is in a second section where the medium is transported only by the transport roller pair of the downstream side of the two transporting roller pairs, the control unit controls the transporting unit in second transporting control different from the first transporting control.

According to the above invention, the regulated distance is set by the setting unit to a value which is smaller than a distance (hereinafter, referred to as a first distance) in the transporting path from the predetermined position where the detection unit performs detection to the transport roller pair of the upstream side. Therefore, when the detection unit detects the hole as the medium absence, the performance of the suspended measuring process can be cancelled at an earlier time at the time when the detection unit detects the medium presence until the transporting for the distance of the hole diameter is finished. In addition, since the regulated distance is set to the value that is smaller than the distance in the transporting path from the predetermined position to the transport roller pair of the upstream side, in the case where the medium absence is detected due to the passing of the end of the sheet through the predetermined position, the suspension is released before the medium reaches the position where it is changed from the first section to the second section, the measuring process of the measuring unit is allowed to start with a value where the suspended transporting amount is reflected. Therefore, the control unit recognizes based on the counted value of the measuring unit that the medium reaches the position where it is changed from the first section to the second section, so that the changing from the first transporting control to the second transporting control can be appropriately performed. Accordingly, a difference in the recording position between the case where the medium is transported by the two transport roller pairs and the case where the medium is transported only by the transport roller pair of the downstream side of the two transport roller pairs cannot easily occur.

In addition, the above recording apparatus may further include: a medium mounting unit on which the medium is set in a stacked state; a feeding unit which feeds the medium from the medium mounting unit; and an interval detection unit which detects that the preceding medium that is fed from the medium mounting unit is transported to a position where the interval between the preceding medium and the following medium on the medium mounting unit is the regulated amount or more, wherein if it is detected that the interval is secured to be the regulated amount or more, the control unit controls the transporting unit and the so that the feeding of the following medium is performed together with the transporting of the preceding medium, and wherein the recording apparatus further includes a second setting unit where the interval is set to a value that is larger than the regulated distance.

According to the above aspect of the invention, if the interval detection unit detects that the preceding medium is transported to the position where the interval to the following medium on the medium mounting unit is equal to or larger than a regulated amount, the control unit allows the transporting unit and the feeding unit to transport the preceding medium and feed the following medium. As a result, during the recording of the preceding medium, the feeding of the following medium is performed in the state where the interval to the preceding medium is maintained to be the regulated amount or more. Therefore, the time interval from the time when the recording of the preceding medium is finished to the time when the recording of the following medium is allowed to start can be shortened, so that it is possible to improve the throughput of the recording. At this time, the interval of the regulated amount or more is set by the second setting unit as a value which is larger than the regulated distance (≧hole diameter) (that is, (the regulated amount as a minimum value of the interval)>regulated distance). Therefore, in the case where the medium absence is determined based on the detection of the hole, the measuring process, which is suspended due to the detection of the medium presence during the transporting for the regulated distance, is cancelled, and in the case where the medium absence is determined based on the detection of the interval (that is, the end of the medium), the suspended measuring process is performed by finishing the transporting for the regulated distance without detection of the medium presence. Accordingly, the interval is distinguished from the hole, and the canceling and the performing of the suspended measuring process can be appropriately selected.

In addition, the above recording apparatus may further include: a discharging distance acquisition unit which acquires a discharging distance necessary to discharge the medium, wherein, after the medium reaches the discharging distance during the medium discharging operation by the transporting unit or after the discharging operation for the discharging distance is finished, if the detection unit detects the medium absence, the control unit further performs the transporting for the regulated distance, wherein if the detection unit detects the medium presence during the transporting for the regulated distance, the control unit performs the discharging operation for a predetermined distance as a predetermined process so as to remove an erroneous operation state with respect to the discharging operation, where a normal operation in the case where the detection of the medium absence is based on passing of the end of the medium through a predetermined position becomes an erroneous operation in the case where the detection of the medium absence is based on detection of the hole; wherein if the transporting for the regulated distance is finished without detection of the medium presence by the detection unit, the control unit does not perform the discharging operation as the predetermined distance, and wherein in the case where the discharging operation for the predetermined distance is performed, when the discharging operation for the predetermined distance is finished, if the detection unit detects the medium absence, the control unit repeats the transporting for the regulated distance, the discharging operation for the predetermined distance, which is to be performed when the detection unit detects the medium presence during the transporting for the regulated distance until the transporting for the regulated distance is finished without detection of the medium presence by the detection unit.

According to the above invention, the control unit further includes the discharging distance acquisition unit which acquires a discharging distance necessary to discharge the medium is further included, so that the discharging distance necessary to discharge the medium is obtained based on the medium length and the medium position in the case where the medium is to be discharged. At the time when the medium reaches the discharging distance during the discharging of the medium or after the discharging operation for the discharging distance is finished, if the detection unit detects the medium absence, the control unit further performs the transporting for the regulated distance. If the detection unit detects the medium presence during the transporting, the discharging operation regulated by the discharging distance becomes an erroneous operation, and the control unit performs the discharging operation as the predetermined process so as to remove the erroneous operation state. In addition, at the time when the medium reaches the predetermined distance during the discharging operation or after the discharging operation for the predetermined distance is finished, if the detection unit detects the medium absence, the transporting of the regulated distance of the medium and the discharging operation, which is to be performed when the detection unit detects the medium presence during the transporting for the regulated distance are repeated until the transporting for the regulated distance is finished without detection of the medium presence by the detection unit. On the other hand, in the case where the transporting for the first regulated distance of the medium is finished without detection of the medium presence by the detection unit, the discharging operation regulated by the discharging distance becomes a normal operation, and in this case, the discharging operation for the predetermined distance is not performed. Accordingly, in the case where the detection unit detects the hole as the medium absence, the discharging operation for the predetermined distance together with the first discharging operation is repeated until the medium absence is detected, so that the medium can be securely discharged. On the other hand, when the medium absence is detected due to the passing of the end of the medium through the predetermined position, the discharging operation for the predetermined distance is not unnecessarily performed after the normal discharging operation.

According to another aspect of the invention, there is provided a recording apparatus for performing recording on a medium, including: a transporting unit which transports the medium; a recording unit which performs the recording on the transported medium; a control unit which controls the transporting unit and the recording unit; and a detection unit which detects presence or absence of the medium at a predetermined position in a transporting path, wherein, during or after the transporting of the medium, if the detection unit detects medium absence, the control unit further performs the transporting of a regulated distance, which is set as a value of a diameter or more of a hole provided to the medium; after the transporting of the regulated distance, the control unit determines the presence or absence of the medium based on a result of the detection of the detection unit; if the medium presence is determined, the control unit performs a predetermined process so as to remove an erroneous operation state, where even a normal operation, in the case where the detection of the medium absence is based on passing of the end of the medium through a predetermined position, becomes an erroneous operation in the case where the detection of the medium absence is based on detection of the hole; if the medium absence is determined, the control unit does not perform the predetermined process; and in the case where the predetermined process is performed, during or after the transporting, if the detection unit detects the medium absence, the control unit repeats the transporting of the regulated distance, the determination of the presence or absence of the medium after the transporting, and the predetermined process, which is to be performed when the result of the determination is the medium presence, until the result of the determination is the medium absence.

According to the above aspect of the invention, during or after the transporting of the medium, after the detection unit detects the medium absence, the transporting for the regulated distance (≧hole diameter) is further performed, and after the transporting, the control unit determines the presence or absence of the medium based on the result of the detection of the detection unit. Next, if the medium presence is determined, the control unit performs a predetermined process for removing the erroneous operation state that is performed based on the detection of the medium absence. On the other hand, if the medium absence is determined, the predetermined process is not performed. Next, in the case where the predetermined operation is performed, during or after the transporting of the medium, when the detection unit detects the medium absence, the transporting for the regulated distance, and the determination of the presence or absence of the medium after the transporting, and the predetermined process, which is to be performed when the result of the determination is the medium presence, are repeated until the result of the determination is the medium absence. Accordingly, it is possible to appropriately remove an erroneous operation state where even a normal operation in the case where the detection of the sheet absence by the detection unit is based on the passing of the end of the sheet through a predetermined position may become an erroneous operation in the case where the detection of the sheet absence of the detection unit is based on the detection of the hole.

According to another aspect of the invention, there is provided a transporting control method in a recording apparatus having a detection unit capable of detecting presence or absence of a medium at a predetermined position in a transporting path, including: performing transporting for a regulated distance, which is set as a value of a diameter or more of a hole provided to the medium during or after transporting of the medium, after the detection unit detects the medium absence; performing a predetermined process of removing an erroneous operation state if the detection unit detects the medium presence during the transporting for the regulated distance, wherein a normal operation, in the case where the detection of the medium absence is based on passing of the end of the medium through a predetermined position, becomes an erroneous operation in the case where the detection of the medium absence is based on detection of the hole, and wherein the predetermined process is not performed in the case where the transporting for the regulated distance is finished without detection of the medium presence by the detection unit during the transporting for the regulated distance, wherein in the case of performing the predetermined process, during or after the transporting, the performing the transporting for the regulated distance and the performing the predetermined process are repeated until the transporting for the regulated distance is finished without detection of the medium presence by the detection unit during the transporting for the regulated distance in the performing the predetermined process. According to the invention, the same advantages as those of the aforementioned recording apparatus can be obtained.

According to another aspect of the invention, there is provided a transporting control method in a recording apparatus having a detection unit capable of detecting presence or absence of a medium at a predetermined position in a transporting path, including: performing transporting for a regulated distance, which is set as a value of a diameter or more of a hole provided to the medium during or after transporting of the medium, if the detection unit detects the medium absence; determining the presence or absence of the medium based on a result of detection of the detection unit, after the transporting for the regulated distance; performing a predetermined process of removing an erroneous operation state if the result of determination in the determining the presence or absence of the medium is the medium presence, wherein a normal operation, in the case where the detection of the medium absence is based on passing of the end of the medium through a predetermined position, becomes an erroneous operation in the case where the detection of the medium absence is based on detection of the hole, and wherein the predetermined process is not performed if the result of determination is the medium absence, wherein in the case where the predetermined process is performed in the performing of the predetermined process of removing the erroneous operation state, during or after the transporting, when the detection unit detects the medium absence, the transporting for the regulated distance, the determination of the presence or absence of the medium after the transporting, and the predetermined process which is to be performed at the time when the result of the determination is the medium presence are repeated until the result of the determination is the medium absence. According to the invention, the same advantages as those of the aforementioned recording apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
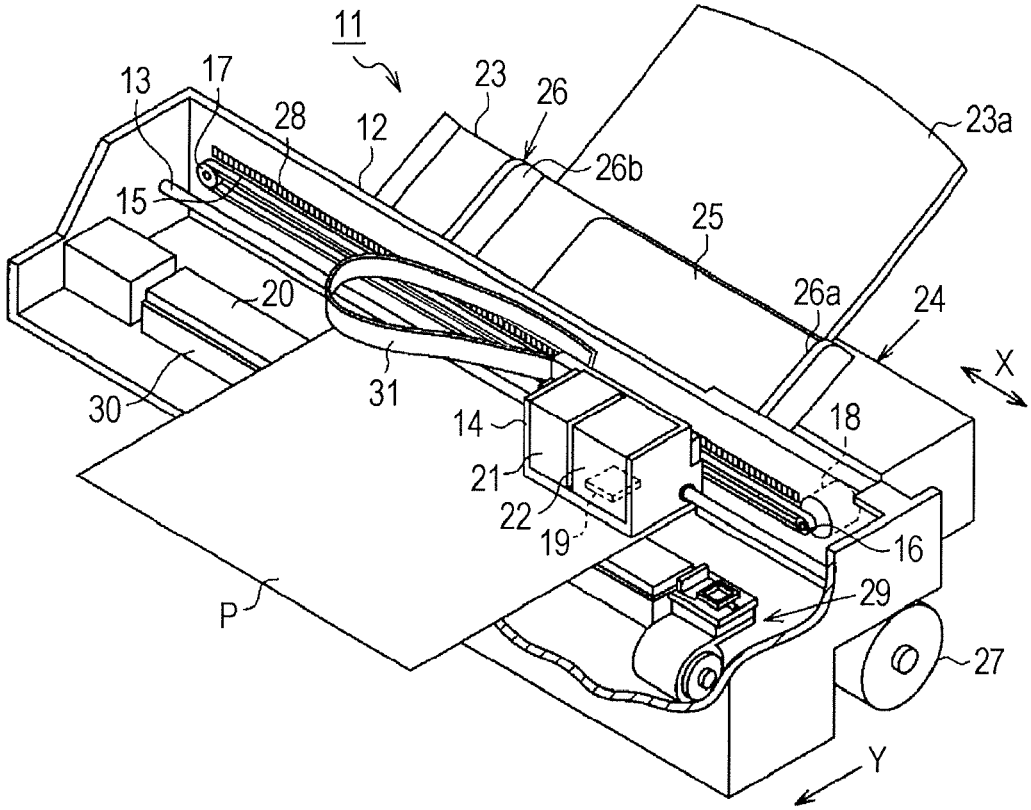
FIG. 1 is a perspective view illustrating a printer according to a first embodiment.

Hereinafter, a first embodiment where a recording apparatus according to the invention is embodied as an ink jet printer will be described with reference to FIGS. 1 to 10. FIG. 1 is a perspective view illustrating an ink jet printer in a state where an outer case is detached. As shown in FIG. 1, the ink jet printer (hereinafter, simply referred to as a "printer 11") as the recording apparatus has a main case 12 having a substantially rectangular box, of which the upper side is open. A carriage 14 is guided in a main scan direction (X direction in FIG. 1) along a guide shaft 13 provided inside the main case 12 so as to be reciprocatingly moved. An endless timing belt 15 where the carriage 14 is fixed on a rear side thereof is wound around a pair of pulleys 16 and 17 that are disposed on the inner surface of the rear plate of the main case 12. A carriage motor (hereinafter, referred to as a "CR motor 18"), of which a driving shaft is connected to the one pulley 16 is driven in forward and backward directions, so that the carriage 14 can be reciprocatingly moved in a main scan direction X.

A recording head 19 (recording unit) that sprays ink is disposed on a lower portion of the carriage 14. In addition, inside the main case 12, at a lower position facing the recording head 19, a platen 20 that defines a gap between the recording head 19 and a sheet P (medium) is disposed to extend in the X direction. In addition, black and color ink cartridges 21 and 22 are detachably mounted on an upper portion of the carriage 14. The recording head 19 is configured to spray (eject) each color ink supplied from each of the ink cartridges 21 and 22 through a nozzle for each color.

A feed tray 23 and an automatic feeding unit 24 (auto sheet feeder) that separates the uppermost one sheet from a plurality of sheets P stacked on the feed tray 23 and supplies the uppermost sheet to the downstream side in the sub scan direction Y are disposed on the rear surface side of the printer 11. The automatic feeding unit 24 is configured to include a hopper 25 that can be slantedly moved in a state that a plurality of the sheets P is stacked on the feed tray 23.

The feed tray 23 is configured to include an edge guide 26 and a sheet support 23*a* so that the sheet P can be positioned in the sheet width direction (in the X direction in FIG. 1). The edge guide 26 is constructed with a pair of a fixed guide 26*a* and a moving guide 26*b*. The movable guide 26*b* is slidingly moved in the X direction, so that the sheet P is positioned in the sheet width direction (in the X direction) with respect to the fixed guide 26*a* as a positioning reference.

In addition, a sheet transporting motor (hereinafter, referred to as a "PF motor 27") is disposed in the right lower portion of the main case 12 in FIG. 1A sheet transport roller pair 35 and a discharge roller pair 36 (refer to FIG. 2) are rotated by driving the PF motor 27, so that the sheet P is transported in the sub scan direction Y. A printing operation where the carriage 14 are reciprocatingly moved in the main scan direction X to spray ink on the sheet P through the nozzles of the recording head 19 and a sheet transporting operation where the sheet P is transported by a predetermined transporting amount in the sub scan direction Y are substantially alternately repeated, so that characters or images can be printed on the sheet P based on the printing data.

In addition, in the printer 11, a linear encoder 28 that outputs pulses, of which the number is proportional to a moving distance of the carriage 14, is disposed to extend along the guide shaft 13. The speed control and position control for the carriage 14 are performed based on the moving position, moving direction, and moving speed of the carriage 14 that are obtained by using the output pulses of the linear encoder 28. In addition, a maintenance unit 29 that preventing and removing the nozzle clogging of the recording head 19 is disposed just below the carriage 14 which is located at the home position of the printer 11 (at the one end position in the carriage moving passage, for example, at the right end position in FIG. 1). In addition, a waste tank 30, into which the ink sucked from the nozzle of the recording head 19 by the maintenance unit 29 is reserved, is disposed below the platen 20.

Figure 2:
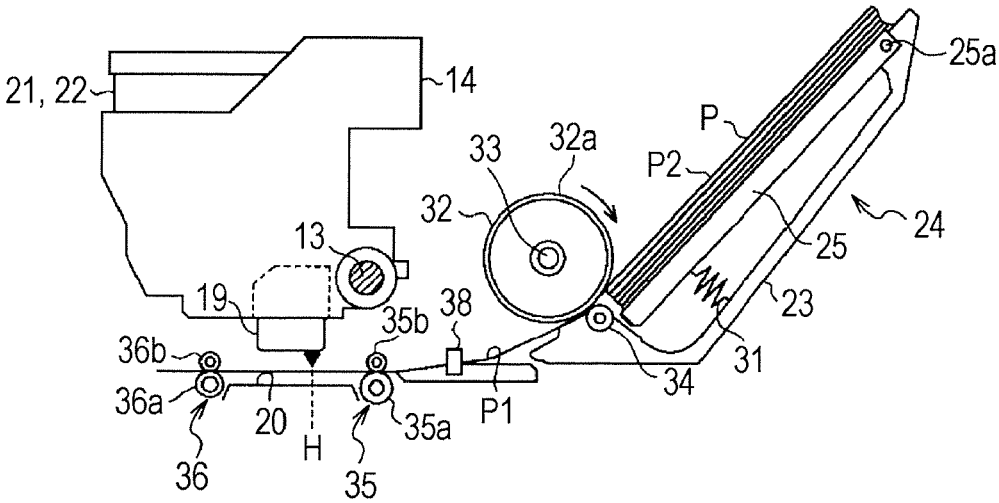
FIG. 2 is a side view illustrating main components of the printer.

FIG. 2 is a diagrammatic side view illustrating an automatic feeding unit and a transporting unit. As shown in FIG. 2, in the upper surface side of the feed tray 23 disposed in a slanted manner in the rear surface portion of the main body, the hopper 25 is supported in the state the hopper 25 can be slantedly moved within a predetermined angle range with respect to a shaft 25*a* in the upper end portion thereof and the hopper 25 is forced in the direction of separation from the feed tray 23 (in the left upper direction in FIG. 2) by a compression spring 31. A feed roller 32 that is configured to rotate around a rotation shaft 33 and a retard roller 34 that is disposed at a position facing the feed roller 32 are disposed in the lower end portion of the hopper 25. The hopper 25 is configured to be slantedly moved between a feeding position shown in FIG. 2 where the sheet on the surface thereof is in contact with the feed roller 32 and a receding position (not shown) where the sheet is separated from the feed roller 32.

The retard roller 34 is configured so that the retard roller 34 can be driven to rotate in the state that constant rotational load is applied thereto by a torque limiting mechanism such as a torque limiter and so that the retard roller 34 can be in contact with or be separated from the feed roller 32. The hopper 25 and the retard roller 34 are cooperatively driven. Therefore, if the hopper 25 is located at the receding position, the retard roller 34 is also located at the receding position where the retard roller 34 is separated from the feed roller 32. If the hopper 25 is located at the feeding position, the retard roller 34 is also located at the feeding position where the retard roller 34 is in contact with the feed roller 32.

In the transporting path of the sheet that is fed from the automatic feeding unit 24, an upstream side sheet transport roller pair 35 and a downstream side discharge roller pair 36 are disposed at positions of two sides with the platen 20 interposed therebetween in the transport direction (left-right direction of the figure). The sheet transport roller pair 35 is constructed with a pair of a transporting driving roller 35*a* and a transporting driven roller 35*b*, and the discharge roller pair 36 is constructed with a pair of a discharging driving roller 36*a* and a discharging driven roller 36*b*.

Figure 6:
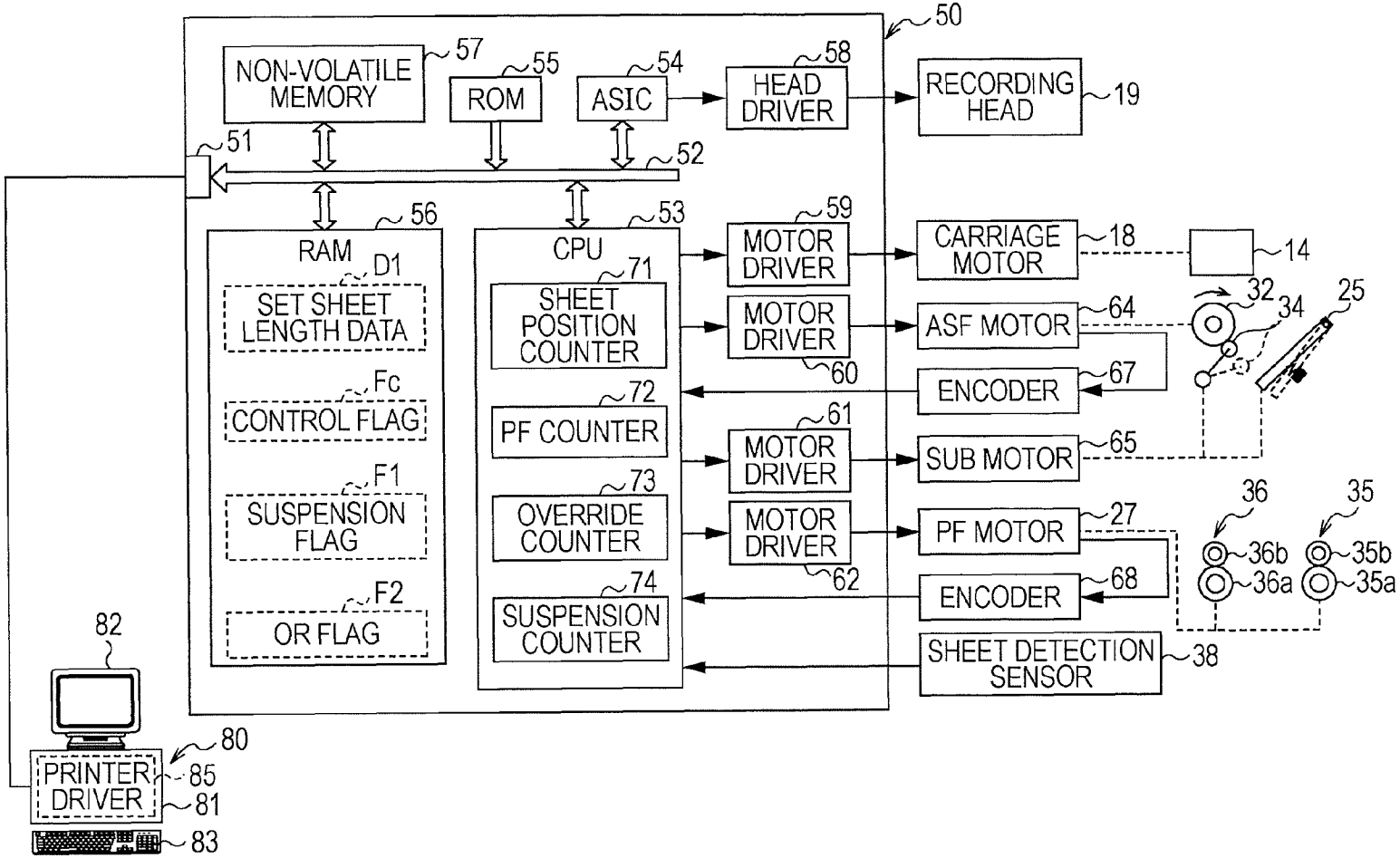
FIG. 6 is a block diagram illustrating an electric configuration of the printer.

The feed roller 32 is driven by an ASF motor 64 (shown in FIG. 6). The transporting driving roller 35*a* and the discharging driving roller 36*a* are driven by a PF motor 27 (refer to FIG. 1). The feeding of the sheet P is performed through the rotation of the feed roller 32 and the sheet transport roller pair 35. The transporting and discharging of the sheet P is performed through the rotation of the sheet transport roller pair 35 and the discharge roller pair 36. In addition, a sheet detection sensor 38 that is constructed with an optical sensor as a detection unit for detecting the presence or absence of the sheet P is disposed at a predetermined position between the feed roller 32 and the sheet transport roller pair 35 in the transporting path. In addition, the feed roller 32 may be driven by the PF motor 27.

As shown in FIG. 2, at the time of feeding, the hopper 25 is slantedly moved in the force direction of the compression spring 31, and the feed roller 32 rotates in the state that the sheet P stacked of the surface thereof is pressed by the feed roller 32, so that the uppermost sheet P1 is fed. At this time, only the uppermost sheet P1 is fed in separation from other sheets by the valance among the rotational resistance of the retard roller 34, the frictional resistance of the circumferential surface of the feed roller 32, and the frictional resistance of the surface of the sheet P. After the feeding of the preceding sheet P1 is completed, the hopper 25 and the retard roller 34 are sustained at the feed position.

The fed sheet P1 is entered until the front end thereof passing through the sheet transport roller pair 35 reaches the print starting position. The print starting position is acquired from the printing condition information among the printing data that the printer 11 receives from the host apparatus 80 (shown in FIG. 6). The print starting position can be determined according to layout conditions such as no-margin (top margin) or no-edge printing. A large number of nozzles (nozzle group) that spray ink are opened on the lower surface of the recording head 19. The position of the nozzle (referred to as the uppermost stream nozzle) located at the uppermost stream in the transport direction in the nozzle group becomes the head reference position H (the position "V" in FIG. 2). The head reference position H is the reset position (origin) of the measured value that is measured when the front end of the sheet P reaches and the recording limit position at which the printing cannot be performed when the end of the sheet P reaches.

Figure 3:
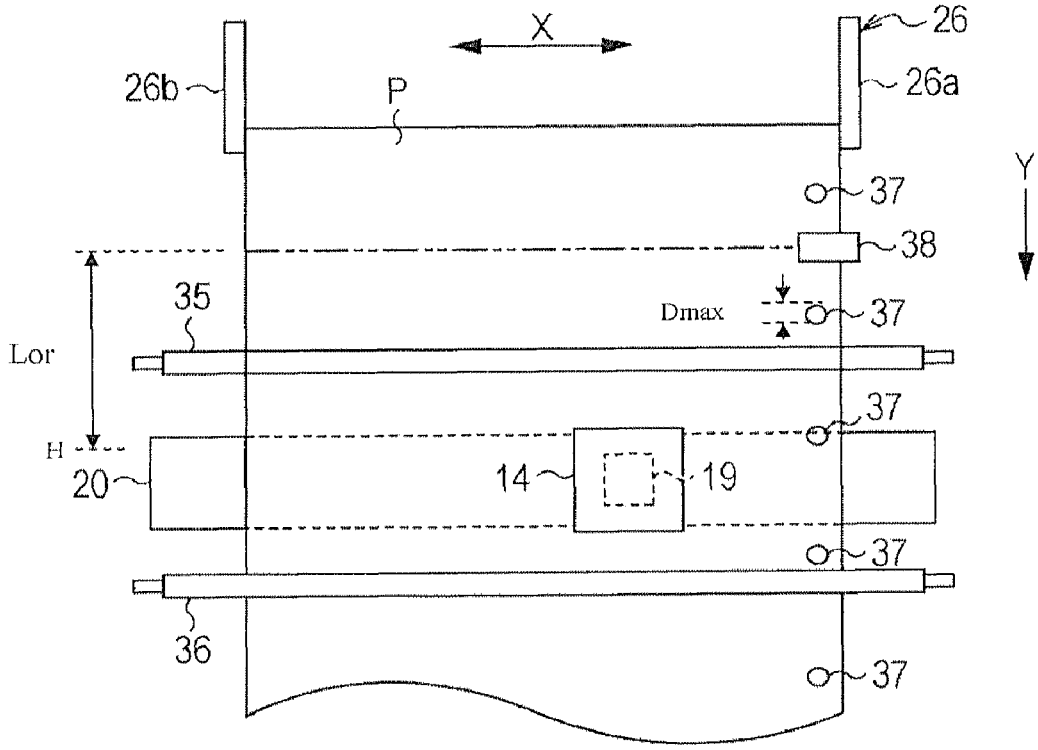
FIG. 3 is a diagrammatic plan view illustrating main components of the printer.

FIG. 3 is a diagrammatic plan view illustrating main components of the printer. As shown in FIG. 3, the sheet P is positioned in the width direction (X direction) with the right side end (right side) in FIG. 3, which is in contact with the fixed guide 26*a*, as the position reference. Therefore, any sheet p irrespective of the size of the sheet is also transported in the state where the right side end thereof is guided by the fixed guide 26*a*. The sheet detection sensor 38 is disposed at the position where the position of the right side end of the sheet P guided by the fixed guide 26*a* is to be detected. As shown in FIG. 3, in the printer 11, the sheet P where filing holes 37 are formed along the side edge may be used as the to-be-printed sheet. In the case where the sheet P is set in the direction shown in FIG. 3, the hole 37 passes through the detection area of the sheet detection sensor 38, so that the sheet detection sensor 38 erroneously detects the edge of the hole 37 as the front end or rear end of the sheet P.

Figure 4A:
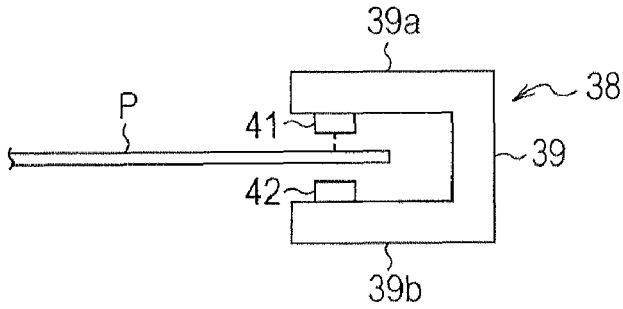
FIG. 4A is a diagrammatic front view illustrating a sheet presence detection state of a sheet detection sensor.
Figure 4B:
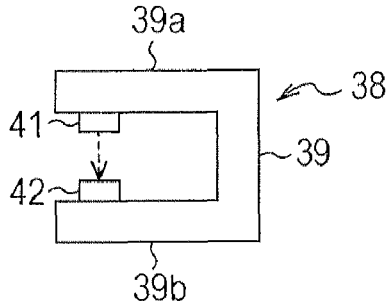
FIG. 4B is a diagrammatic front view illustrating a sheet absence detection state of a sheet detection sensor.

FIGS. 4A and 4B are front views illustrating the sheet detection sensor. As shown in FIGS. 4A and 4B, the sheet detection sensor 38 is configured to include a main body 39 having a substantially U shape as viewed from the front in FIGS. 4A and 4B. Two arms 39*a* and 39*b* constituting the main body 39 are disposed so that the arms face each other in separation from the right side edge portion of the transporting sheet P at the upper and lower positions thereof. A light-emitting unit 41 and a light-receiving unit 42 are fixed to face each other on the corresponding facing surfaces of the two arms 39*a* and 39*b*. As shown in FIG. 4A, if the light projected from the light-emitting unit 41 is blocked by the sheet P, the light is not received by the light-receiving unit 42, so that the sheet detection sensor 38 detects sheet presence. In addition, as shown in FIG. 4B, if there is no sheet P that blocks the light projected from the light-emitting unit 41, the light projected from the light-emitting unit 41 is received by the light-receiving unit 42, so that the sheet detection sensor 38 detects sheet absence. In addition, the sheet detection sensor 38 may be a reflective detection type optical sensor, where the sheet presence is detected by the light-receiving unit receiving a reflected light obtained from the reflection of the light emitted from the light-emitting unit 41 on the surface of the sheet, or a contact type sensor (switch type sensor). In other words, any sensor that cannot erroneously detect the edge of the hole formed on the medium such as the sheet P as the sheet rear end (sheet end) can be used without limitation to the detection type.

Figure 5A:
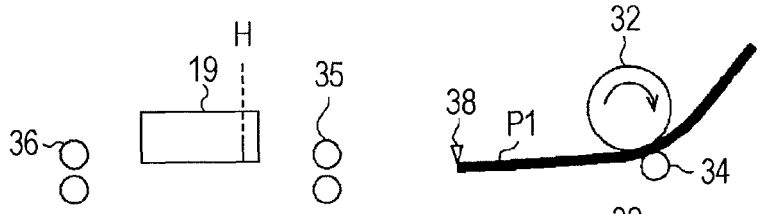
FIGS. 5A to 5E are diagrammatic side views for explaining sheet position managing operations and operations of a transporting system.
Figure 5B:
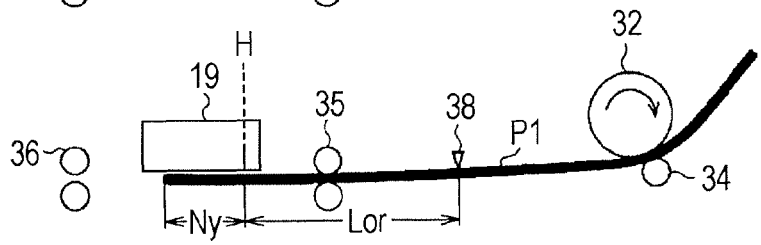

FIGS. 5A to 5E are diagrammatic side views illustrating the transporting system. FIG. 5A illustrates a state where the front end of the sheet P1 is sensed by the sheet detection sensor 38. If the front end of the fed sheet P1 reaches a predetermined position so that the detection state of the sheet detection sensor 38 is completely changed from the "sheet absence" to the "sheet presence" (if the front end of the sheet is sensed), since the distance Lor (hereinafter, referred to as an "OR distance Lor")(refer to FIG. 5B) in the transporting path between the predetermined position and the head reference position H (uppermost stream nozzle position) is known, by transporting the sheet P1 only by the OR distance Lor, the sheet P1 is transported until the front end of the sheet P1 reaches the head reference position H. When the front end of the sheet P1 is coincident with the head reference position H, the later-described sheet position counter 71 (shown in FIG. 6) is reset, so that the position of the sheet where the front end is coincident with the head reference position H is set to the origin, and the position of the sheet P1 is managed by the counted value Ny of the sheet position counter 71 (hereinafter, sometimes referred to as a "sheet position Ny") (refer to FIG. 5B). In other words, the position of the sheet P1 is managed by the counted value Ny of the sheet position counter 71, which denotes the distance in the transport direction from the front end of the sheet P1 to the position facing to the head reference position H.

Figure 5C:
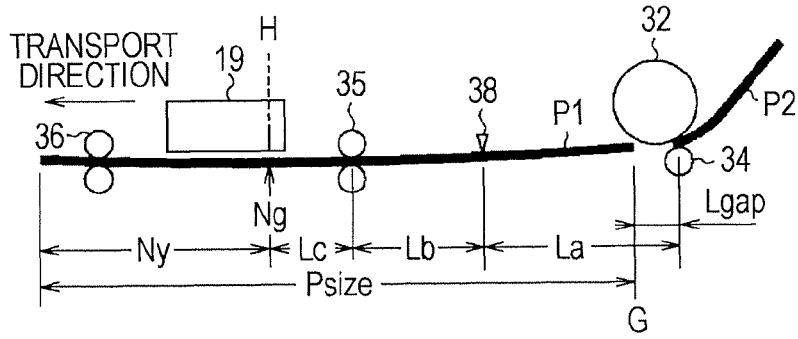

In the embodiment, during the printing of the preceding sheet P1, the feeding of the following sheet P2 is performed with a predetermined interval from the preceding sheet P1. FIG. 5C illustrate a state where the preceding sheet P1 reaches the feed starting position and the following sheet P2 starts to be fed. At the time when the preceding sheet P1 is released from the nip between the feed roller 32 and the retard roller 34, the rotation of the feed roller 32 is temporarily stopped. After that, the preceding sheet P1 is transported through the rotation of the sheet transport roller pair 35 and the discharge roller pair 36. As shown in FIG. 5C, if the interval between the preceding sheet P1 and the following sheet P2 is secured as the regulated amount Lgap or more, the rotation of the feed roller 32 is performed together with the rotation of the sheet transport roller pair 35. Therefore, the interval between the sheets P1 and P2 can be secured as the regulated amount Lgap or more, and the feeding of the following sheet P2 proceeds to be performed at the same time of the transporting of the preceding sheet P1. Since the interval of the regulated amount Lgap or more is secured, the detection of the rear end of the preceding sheet P1 (sheet presence->sheet absence) and the detection of the front end of the following sheet P2 (sheet absence->sheet presence) can be performed by the sheet detection sensor 38. In the embodiment, the regulated amount Lgap is set so that the regulated amount Lgap is longer than an estimated maximum hole diameter Dmax of the hole 37.

In FIG. 5C, "Psize" is a set sheet length (length of the sheet in the transport direction length) that is determined from the information on the sheet size included in the printing condition information (printing parameters) among the printing data that the printer 11 receives from the printer driver 85 of the host apparatus 80. Herein, a distance La in the transporting path from the nip point between the feed roller 32 and the retard roller 34 to the position (predetermined position) of the sheet detection sensor 38, a distance Lb in the transporting path from the position (predetermined position) of the sheet detection sensor 38 to the nip point of the sheet transport roller pair 35, and a distance Lc in the transporting path from the nip point of the sheet transport roller pair 35 to the head reference position H are known. Therefore, if the sheet position Ny has the value obtained by subtracting a known distance (La+Lb+Lc−Lgap) from the set sheet length "Psize" (the sheet position in FIG. 5C), the preceding sheet P1 reaches the feed starting position Ng (=Psize−La−Lb−Lc+Lgap) where the feeding of the following sheet P2 is to start.

Figure 5D:
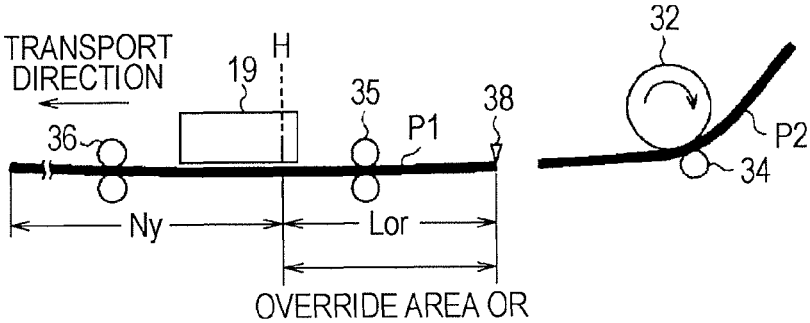

In addition, as shown in FIG. 5D, the rear end (end) of the sheet P passes through the position (predetermined position) of the sheet detection sensor 38, and the detection state thereof is completely changed from the "sheet presence" to the "sheet absence" (that is, the sheet rear end is detected). After that, the override area OR is set as the range where the sheet rear end is located in the transport direction until the sheet rear end reaches the printing limit position (recording limit position). More specifically, as shown in FIG. 5D, the override area OR is set as an area from the to-be-detected position (predetermined position) of the sheet detection sensor 38 to the head reference position H (uppermost stream nozzle position) of the recording head 19. For example, in the case where a sheet P, of which an actual sheet length is smaller than the set sheet length Psize, is erroneously set, although the sheet rear end is passing through the head reference position H, the printing is performed, so that the platen 20 may be contaminated by ink. For this reason, the sheet position at the time when the sheet rear end is located within the override area OR is managed, and at the time when the sheet rear end reached head reference position H, the printing is forcibly stopped, so that the sheet P1 is allowed to be discharged.

Herein, until the rear end of the sheet P1 is detected by the sheet detection sensor 38, the sheet position managing is performed according to the sheet position Ny. After the rear end of the sheet P1 is detected by the sheet detection sensor 38, the sheet position managing is performed according to the counted value My (referred to as a "sheet position My") that is obtained by subtracting the transporting amount of the sheet P1 from the OR distance Lor. Therefore, if the sheet position My is "0", the rear end of the P1 reaches the head reference position H (printing limit position). Therefore, in order to prevent the printing of the platen 20 (ejection of ink droplets), the printing operation is forcibly finished.

Figure 5E:
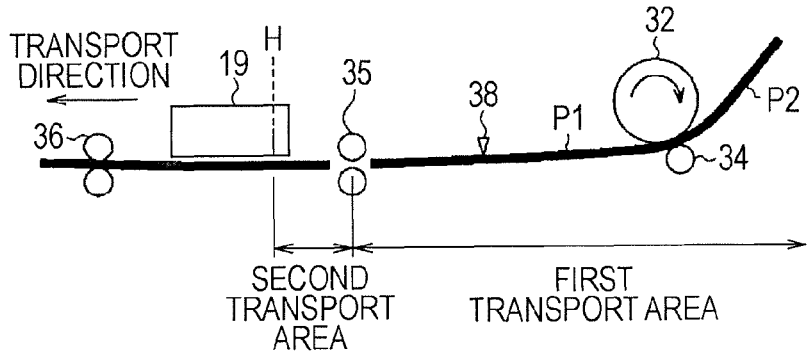

In addition, during the printing, there are a section shown in FIGS. 5C and 5D, where the sheet P1 is transported in the state where the sheet P1 is nipped by the sheet transport roller pair 35 and the discharge roller pair 36, and a section shown in FIG. 5E, where the sheet P1 is transported in the state where the sheet P1 is nipped not by the sheet transport roller pair 35 but by the discharge roller pair 36. The two sections are divided into a first transport area where the rear end of the sheet P1 is located at the upstream in the transport direction from the nip point of the sheet transport roller pair 35 and a second transport area where the rear end of the sheet P1 is located within the range between the nip point of the sheet transport roller pair 35 and the printing limit position (head reference position H) by managing the position of the rear end of the sheet P1 as shown in FIG. 5E. Herein, the transporting manner for the sheet P is different between the first transport area where the sheet P1 is transported in the state where the sheet P1 is nipped by the roller pairs 35 and 36 and the second transport area where the sheet P1 is transported in the one-side-held state where the sheet P1 is nipped only by the discharge roller pair 36. Due to the difference in the transporting manner, slight variation occurs in the position of the printing. In order to suppress the slight variation in the position of the printing, a first transporting control (normal transporting control) is performed in the section (sheet two-side-held section) where the sheet rear end is located in the first transport area, and a second transporting control (transporting control added with correction of the variation in the position of the printing caused by the one-side-held transporting) different from the first transporting control is performed in the section (sheet one-side-held section) where the sheet rear end is located in the second transport area. Changeover between the first transporting control and the second transporting control is performed when the sheet position My is less than the value of the distance (Lor−Lb) so that the rear end of the sheet P1 reaches the nip point of the sheet transport roller pair 35.

Next, an electrical configuration of the printer is described with reference to FIG. 6. As shown in FIG. 6, the printer 11 includes a controller 50 that performs various control operations. The controller 50 is configured to include a communication interface (hereinafter, referred to as a "communication I/F 51") that is communicatably connected to the host apparatus 80. A CPU 53, an ASIC 54 (application specific IC), a ROM 55, a RAM 56, a non-volatile memory 57, and the like are connected to a bus 52 which is connected to the communication I/F 51. Various programs including a printing control routine shown in a flowchart in FIG. 8, a printing control routine shown in a flowchart in FIG. 9, and a discharging control routine shown in a flowchart in FIG. 10 are stored in the ROM 55 or the non-volatile memory 57. In addition, various data including speed control data for controlling speeds of the ASF motor 64 and the PF motor 27 are stored in the ROM 55 and the non-volatile memory 57. The CPU 53 executes these programs to perform the feeding control, the sheet transporting control, the printing control, the discharging control, and the like and to control speed control for the feeding system and the transporting system based on the speed control data.

The host apparatus 80 is configured to include a main body 81, a monitor 82, and an input unit 83. A printer driver 85 is built in the main body 81 of the host apparatus 80. If the printer driver 85 receives the printing instruction from the input unit 83, the printer driver 85 performs a predetermined process on the to-be-printed image data to generate the printing data. More specifically, the printer driver 85 sequentially performs well-known resolution conversion process, color conversion process, halftone process, rasterizing process (micro-weaving process) or the like on the image data to generate the printing image data. Next, the printer driver 85 generates the printing data by adding the command information expressed in a printer description language and the printing image data to the header including various printing parameters (printing conditions) such as a sheet size (set sheet length), a paper type, and a layout that are input and set by a user through the input unit 83.

The CPU 53 receives as input the printing data, which the communication I/F 51 receives from the printer driver 85 of the host apparatus 80, through the bus 52 and acquires the set sheet length Psize from the sheet size of the header among the printing data that are initially received from the host apparatus 80. In addition, the CPU 53 analyzes command information included in the header of the printing data to acquire various commands associated with the sheet feeding, the sheet transporting, the sheet discharging, and the like, various parameters for controlling the transporting, and the like.

The ASIC 54 receives the printing image data among the printing data from the CPU 53, performs an image process or the like on the printing image data to develop the printing image data into bitmap data, and transmit bitmap data to the head driver 58. The head driver 58 controls the recording head 19 to eject ink droplets through the nozzles based on the bitmap data.

In addition, motor drivers 59, 60, 61, and 62 are connected to the CPU 53. The CPU 53 allows the motor drivers 59 to 62 to control the CR motor 18, the ASF motor 64, the sub motor 65, and the PF motor 27. In addition, the output shaft of the PF motor 27 are connected to the transporting driving roller 35*a* to the discharge driving roller 36*a* through a series of wheels (not shown) so as to transmit power thereto. The ASF motor 64 is connected to the feed roller 32 so as to transmit power thereto. In addition, the sub motor 65 is connected to the retard roller 34 and the hopper 25 so as to transmit power thereto. The retard roller 34 and the hopper 25 are cooperatively moved between the receding position and the feeding position. In addition, in the embodiment, the transporting unit is constructed with the motor drivers 60 and 62, the ASF motor 64, the PF motor 27, the feed roller 32, the sheet transport roller pair 35, the discharge roller pair 36, and the like.

In addition, rotary encoders (hereinafter, referred to as encoders 67 and 68) that detect rotation of the output shafts of the ASF motor 64 and the PF motor 27 are connected to the CPU 53. Each of the encoders 67 and 68 outputs to the CPU 53 a pulse signal having a period that is inversely proportional to the rotational speed of the corresponding motor. In addition, an ON/OFF signal that is in the ON state at the time of detecting sheet presence by the sheet detection sensor 38 and is in the OFF state at the time of detecting sheet absence are output to the CPU 53. The CPU 53 senses the sheet front end when the detection state of the sheet detection sensor 38 is completely changed from the sheet absence to the sheet presence. The CPU 53 senses the sheet rear end when the detection state is completely changed from the sheet presence to the sheet absence. However, when the edge of the hole 37 is detected by the sheet detection sensor 38, the state is completely changed from the sheet presence to the sheet absence. Therefore, even through the state is completely changed from the sheet presence to the sheet absence, the sheet rear end and the edge of the hole 37 may not be distinguished.

In addition, the CPU 53 is configured to include a sheet position counter (hereinafter, referred to as a "position counter 71"), a PF counter 72, an override counter (hereinafter, referred to as an "OR counter 73"), and a suspension counter 74. If the sheet detection sensor 38 detects the front end of the sheet (sheet absence->sheet presence), the position counter 71 is reset by the CPU 53. After reset, the position counter 71 counts the number of pulse edges of the pulse signal input from the encoder 68. Next, if the counted value becomes a value where the front end of the sheet reaches the head reference position H, the position counter 71 is reset again. After reset, the position counter 71 counts the sheet position Ny with respect to the head reference position H as the origin.

In addition, the PF counter 72 counts the number of pulse edges of the pulse signal input from the encoder 68 that detects the rotation of the PF motor 27. The PF counter 72 counts the counted value corresponding to the transporting amount during the one-time driving of the PF motor 27. The CPU 53 checks the transporting position of the sheet during one-time transporting from the counted value of the PF counter 72. Next, the CPU 53 acquires a speed command value corresponding to the transporting position with reference to a speed control table (not shown) stored in, for example, a non-volatile memory 57 and issues the speed command value to the motor driver 62, so that the speed of the PF motor 27 I controlled according to a predetermined speed profile.

The OR counter 73 counts the counted value My corresponding to the remaining transporting amount from the sheet position at the time where the sheet detection sensor 38 detects the rear end of the sheet (sheet presence->sheet absence) until the rear end of the sheet reaches the printing limit position. More specifically, the OR counter 73 is a subtraction counter. The OR counter 73 counts the value that is obtained by subtracting from the override value Mor, that is, the counted value corresponding to the OR distance Lor the counted value corresponding to the transporting amount of the sheet after the detection state of the sheet detection sensor 38 is completely changed from the sheet presence to the sheet absence. However, although the detection state of the sheet detection sensor 38 is completely changed from the sheet presence to the sheet absence, the OR counter 73 suspends the performance of the counting process (subtraction process) until the sheet is transported only by the regulated distance Ln.

The suspension counter 74 counts the number of pulse edges output from the encoder 68 during the suspending time interval, so that the transporting amount of the sheet during the suspending time interval is counted. In other words, if the sheet detection sensor 38 detects the rear end of the sheet (sheet presence->sheet absence), the suspension counter 74 starts counting of the number of pulse edges output from the encoder 68 and counts the counted value Ry corresponding to the transporting amount from the detected position of the rear end of the sheet. Next, if the counted value Ry of the suspension counter 74 becomes the regulated distance Ln without sheet presence detection (sheet absence->sheet presence) of the sheet detection sensor 38 during the time interval, the CPU 53 sets the initial value Mo of the OR counter 73 to the value corresponding to the transporting amount from the override value Mor during the suspending time interval (the value that is obtained by reflecting the transporting amount during the suspending time interval to the override value Mor). More specifically, the CPU 53 obtains the initial value Mo by subtracting from the override value Mor the counted value Rn of the suspension counter 74 corresponding to the transporting amount (=regulated distance Ln) during the suspending time interval (=Mor−Rn), and the obtained initial value Mo is set to the OR counter 73. After that, the initial value Mo set to the OR counter 73 is subtracted (decreased) by "1" when there is an input of a pulse edge from the encoder 68. The CPU 53 recognizes that the printing is available until the OR counter 73 becomes "0".

Herein, the regulated distance Ln is a value so that $Ln \geqq Dmax$, wherein the Dmax is an estimated maximum hole diameter of the filling hole 37 formed on the sheet. In the embodiment, the regulated distance Ln is set so that $Ln=Dmax+\alpha$. Herein, $\alpha$ is the margin. Data that are stored in the non-volatile memory 57 in advance may be used as the estimated maximum hole diameter Dmax. In addition, a value of a diameter of the filling hole corresponding to the to-be-printed sheet, which is set and input by a user through the input unit 83 of the host apparatus 80 or a manipulation portion of a manipulation panel (not shown) of the printer 11, or a value that is obtained by adding a margin a to the set value may be used as the estimated maximum hole diameter Dmax.

In addition, in the embodiment, the regulated distance Ln is set to a value smaller than the distance Lb in the transporting path between the sheet detection sensor 38 and the nip point of the sheet transport roller pair 35 ($Ln<Lb$). The value of the margin $\alpha$ is set so that the condition $Ln<Lb$ is satisfied. Particularly, the margin $\alpha$ may be a value smaller than an estimated minimum hole interval Bmin of the to-be-printed sheet and, for example, preferably, $1 \leqq \alpha < Bmin$ (mm). In the case where the estimated minimum hole interval Bmin is determined in advance, although the estimated minimum hole interval Bmin may be set to a value in a range of 5 to 10 mm, a user may be allowed to input information of "sheet size and number of holes" or "hole interval" through manipulation of the input unit 83 or the manipulation portion of the manipulation panel, and the hole interval determined based on the information may be used as the estimated minimum hole interval Bmin. Therefore, the regulated distance Ln is set so that the condition $Ln=Dmax+\alpha<Lb$ is satisfied.

In addition, the interval between the preceding sheet P1 and the following sheet P2 is secured to be the regulated amount Lgap or more, and the regulated amount Lgap is set to a value larger than the regulated distance Ln ($Lgap>Ln$). In this case, the regulated amount Lgap is set by using the margin $\beta$ so that $Lgap=Ln+13$. Herein, as the margins $\alpha$ and $\beta$ are set to as small value as possible, the regulated amount Lgap can be set to be small, so that the interval between the preceding sheet P1 and the following sheet P2 can be small. Therefore, the throughput of printing can be improved. Therefore, the margins $\alpha$ and $\beta$ are set so that the margins are in a range of, for example, 1 to 10 mm (sometimes, $\alpha \neq \beta$), and the margin $\alpha$ is set so that the aforementioned condition $0<\alpha<Bmin$ is satisfied.

In addition, the counters 71 to 73 are not limited to a configuration where the counters are included in the CPU 53, but some or the entire thereof may be assembled in the motor driver 62. In this case, the CPU 53 reads the counted value of the counter from the motor driver 62. In addition, the counters 71 to 73 are not limited to a configuration where the counters are constructed with electronic circuits, but some or the entire thereof may be software counters that the CPU 53 configures by executing a program.

In addition, set sheet length data D1 that are acquired from the information of the sheet size among the printing data are stored in the RAM 56. In addition, a transporting control flag Fc, a suspension flag F1, and an override flag (hereinafter, referred to as an "OR flag F2") are stored in a predetermined storage area of the RAM 56. If the detection state of the sheet detection sensor 38 is completely changed from the sheet presence to the sheet absence, the CPU 53 resets the suspension counter 74 to start counting the transporting amount of the sheet during the suspension and to set the suspension flag F1 to "1". In addition, when the suspension flag F1 is "1", if the counted value Ry of the suspension counter 74 becomes the counted value Rn corresponding to the regulated distance Ln, if the detection state of the sheet detection sensor 38 is completely changed from the sheet absence to the sheet presence, the CPU 53 perform an initial value setting process on the OR counter 73 and sets the suspension flag to "0".

When the initial value setting process is performed, the CPU 53 sets the OR flag F2 to "1". After that, when the counted value of the OR counter 73 becomes "0", the CPU 53 sets the OR flag F2 to "0". Therefore, the CPU 53 determines based on the value of the suspension flag F1 and the value of the OR flag F2 whether to be in the suspending time or the override measuring time. In addition, when the CPU 53 drives the PF motor 27, if the transporting control flag Fc is "0", the CPU 53 performs the first transporting control; and if the transporting control flag Fc is "1", the CPU 53 performs the second transporting control.

Next, operations of the printer are described with reference to FIGS. 8 to 10. If the printing data are received, the CPU 53 executes a printing control routine in FIG. 8 and a sheet position managing routine in FIG. 9. In addition, even in the case where the printing data are internally generated based on image data read from a memory inserted into a slot (not shown), the printer 11 executes the routine.

Now, first, the printing control is described with reference to a flowchart in FIG. 8. In addition, the CPU 53 acquires printing condition information among the printing data and temporarily stores the printing condition information in the RAM 56. For example, the set sheet length data D1 is stored in the RAM 56.

First, in Step S10, the transporting control flag Fc is set so that Fc=0.

In the next Step S20, the sheet feeding is performed. In other words, the CPU 53 drives the sub motor 65 to move the hopper 25 and the retard roller 34 to the feeding positions thereof, so that the ASF motor 64 is driven to rotate in the feedable state. As a result, the uppermost sheet among the sheets stacked on the feed tray 23 is fed in the state where the sheet is nipped between the feed roller 32 and the retard roller 34. If the front end of the sheet P is fed to a predetermined position, and if the sheet detection sensor 38 detects the front end of the sheet P (sheet absence->sheet presence), the position counter 71 is allowed to start counting the transporting amount. If the counted value of the position counter 71 becomes the value where the front end of the sheet P reaches the head reference position H (refer to FIGS. 2 and 5), the position counter 71 is reset to count the counted value Ny again. Next, if the counted value Ny of the position counter 71 becomes the value corresponding to the print starting position that is determined from the top margin (upper side margin) of the printing condition information (printing parameter), the driving of the PF motor 27 is stopped. As a result, the sheet P is entered at the print starting position.

In Step S30, the printing is performed. In other words, the CPU 53 drives the CR motor 18 to move the carriage 14 in the main scan direction X and to spray ink droplets through the nozzles of the recording head 19 during the movement of the carriage, so that the printing for one line is performed.

In Step S30, the position of the sheet rear end is calculated from the sheet position and the set sheet length Psize. More specifically, the CPU 53 calculates a rear end position Pr, which is expressed by a distance in the transporting path to the upstream side in the transport direction with respect to the head reference position H as the reference, by Pr=Psize−Ny by using the counted value Ny of the position counter 71 that is subjected to the counting process in the later-described sheet position managing routine and the value of the set sheet length Psize.

In Step S50, it is determined whether or not the rear end position exceeds the feed starting position G. In other words, it is determined whether or not the position of the rear end of the sheet P1 reaches the position where the interval of the regulated amount Lgap or more with respect to the following sheet P2 can be secured. The feed starting position G is expressed by G=La+Lb+Lc (refer to FIG. 5C) by using a scale on the transport passage toward the transport-direction upstream side with the head reference position H as the reference. Therefore, if the condition Pr<G is satisfied, it can be determined that the rear end position exceeds the feed starting position G. If rear end position does not exceed the feed starting position G (Pr≧G), the procedure proceeds to Step S60. If the rear end position exceeds the feed starting position G (Pr<G), the procedure proceeds to Step S70. In addition, in the embodiment, the interval detection unit is constructed by the CPU 53 that executes the processes of Steps S40 and S50. In addition, the interval detection unit may be constructed with a sensor that can detect that the rear end passes through the feed starting position.

In Step S60, the sheet transporting is performed. In other words, the CPU 53 drives the PF motor 27 to move the sheet P1 to the position where the printing position for the next line on the sheet P1 faces the nozzles of the recording head 19.

Herein, until the rear end of the sheet P1 passes through the feed starting position G, only the moving of the sheet P1 is performed. In the automatic feeding unit 24 according to the embodiment, since the hopper 25 and the retard roller 34 are sustained at the feeding position during the printing for the preceding sheet P1, the feeding of the following sheet P2 is continuously performed following the rear end of the preceding sheet P1. Therefore, if the rear end of the preceding sheet P1 passes through the nip point of the feed roller 32, the ASF motor 64 is stopped to wait for the feeding of the following sheet P2. Next, if the rear end of the preceding sheet P1 passes through the feed starting position G, in Step S70, the sheet transporting operation for the preceding sheet P1 and the feeding operation for the following sheet P2 are simultaneously performed. Therefore, after the rear end of the preceding sheet P1 passes through the feed starting position G, the sheeting transporting for the preceding sheet P1 and the feeding for the following sheet P2 proceeds to be performed so that the interval of the regulated amount Lgap or more is sustained. In addition, during the printing for the preceding sheet P1, the hopper 25 and the retard roller 34 may be configured to wait at the receding positions; and if the rear end of the preceding sheet P1 passes through feed starting position G, the hopper 25 and the retard roller 34 may be configured to move to the feeding positions to start feeding the following sheet P2.

In addition, in the sheet transporting control of Steps S60 and S70, the CPU 53 checks the value of the transporting control flag Fc. If the transporting control flag Fc is "1", the CPU 53 drives the PF motor 27 in the first transporting control. On the other hand, if the transporting control flag Fc is "0", the CPU 53 drives the PF motor 27 in the second transporting control. In the later-described Step S80, until the entering into the second transport area is determined to be completed, since the value of the transporting control flag Fc is "0", the PF motor 27 is driven in the first transporting control.

In the next Step S80, it is determined whether or not the entering into the override area is completed. More specifically, if the flag F2 is "1", the CPU 53 determines that the entering into the override area is completed. If the flag F2 is "0", the CPU 53 determines that it is before the entering into the override area. If it is before the entering into the override area, the procedure proceeds to Step S120, so that the printing is performed. On the other hand, if the entering into the override area is completed, the procedure proceeds to Step S90.

In Step S90, it is determined whether or not the entering into the second transport area is completed. In other words, the CPU 53 determines whether or not the counted value My of the OR counter 73 is smaller than the value Mb corresponding to the position of the entering into the second transport area (that is, whether or not the condition My<Mb is satisfied). If the entering into the second transport area is not completed (My≧Mb), the procedure proceeds to Step S120, so that the printing is performed. On the other hand, if the entering into the second transport area is completed (My<Mb), in Step S100, the transporting control flag is changed from "0" to "1", so that the setting is changed from the first transporting control to the second transporting control.

In the next Step S110, it is determined whether or not the counted value My of the OR counter 73 (OR counter value My) is "0". In other words, it is determined whether or not the rear end of the sheet P reaches the printing limit position (head reference position H) where the printing continues to be performed on the platen 20. If the OR counter value My is not "0", the procedure proceeds to Step S120, where the printing continues to be performed. On the other hand, if the OR counter value My is "0", the procedure proceeds to Step S150, where the discharging operation is performed. Since the CPU 53 forcibly steps the printing operation before the discharging operation is performed, the printing on the platen 20 can be prevented.

On the other hand, in the case where the printing is performed in Step S120, in the next Step S130, it is determined whether or not the printing for one page is finished. If the printing for one page is not finished, the procedure returns to Step S40, where the processes of Steps S40 to S130 are repeated until it is determined that the printing for one page is finished in Step S130, so the printing proceeds to be performed line by line. On the other hand, if the printing for one page is finished, the procedure proceeds to Step S140, so that it is determined whether or not the printing for the preceding page is finished. If the printing for the entire pages is not finished, the printing for one page of this time is finished. Therefore, the procedure returns to Step S10, and, similarly, the processes of Steps S10 to S140 are repeated in order to perform the printing for the next page. At this time, the discharging operation is not performed, and the feeding operation for the next page is performed (S20). However, the ASF motor 64 and the PF motor 27 are driven to rotate the sheet transport roller pair 35 and the discharge roller pair 36, so that the discharging of the preceding sheet P1 is also performed.

Next, until the printing for the entire pages is determined to be finished in Step S140, the processes of Steps S10 to S140 are repeated, so that the printing proceeds to be performed page by page. Next, if the printing for the entire pages is determined to be finished in Step S140, the discharging operation is performed in the next Step S150. The discharging operation is performed according to the later-described discharging control routine in FIG. 10.

Now, the sheet position managing routine that is executed during the printing is described with reference to a flowchart in FIG. 9. The count value of the position counter 71, the values of the flags F1 and F2, or the like is managed by the sheet position managing routine. If the printing data are received, the CPU 53 executes the printing control routine in FIG. 8 and the sheet position managing routine in FIG. 9.

First, in Step S210, the suspension flag F1 and the OR flag F2 are reset (F1=0, F2=0).

In the next Step S220, a distance Lb fro the position of the sheet detection sensor 38 and the second transport area is acquired. In other words, the CPU 53 reads from the data of the distance Lb from a predetermined storage area of the non-volatile memory 57.

In the next Step S230, the regulated distance Ln of the estimated maximum hole diameter Dmax or more is set so that Ln<Lb. More specifically, the CPU 53 sets the regulated distance Ln so that Ln=Dmax+α. Herein, the margin α is selected as the small value in a range of a satisfying Dmax+α<Lb, for example, as the value in a range of 1 to 5 mm. In addition, in the case where a user inputs a hole diameter through an input unit 83 or a manipulation panel, the regulated distance Ln is calculated based on the hole diameter as the estimated maximum hole diameter Dmax. In addition, in the embodiment, the setting unit is configured by the CPU 53 that executes the process of Step S230.

In Step S240, the regulated amount Lgap is set so that Lgap>Ln. In addition, in the embodiment, the second setting unit is configured by the CPU 53 that executes the process of Step S240.

In Step S250, it is determined whether or not the sheet front end reaches the head reference position H. If the sheet front end does not reach the head reference position H, it is waited until the sheet front end reaches the head reference position H. On the other hand, if the sheet front end reaches the head reference position H, the procedure proceeds to Step S260, so the measurement of the sheet position starts. In other words, the CPU 53 resets the position counter 71 and allows the position counter 71 to start the measurement of the sheet position Ny. After that, the sheet is entered, so that the printing starts.

In the next Step S270, it is determined whether or not the printing for one page is finished. If the printing is finished, the corresponding routine is ended. On the other hand, if the printing is not finished, the procedure proceeds to Step S280, so that it is determined whether or not the detection state of the sheet detection sensor 38 is completely changed from the sheet presence to the sheet absence. If the detection state is not completely changed from the sheet presence to the sheet absence, the procedure returns to Step S270, so that the processes of Steps S270 and S280 are repeated until the one determination condition is satisfied. On the other hand, if the detection state is completely changed from, the procedure proceeds to Step S290.

In Step S290, the position of the sheet at the time when the detection state of the sheet detection sensor 38 is completely changed from the sheet presence to the sheet absence is stored in the RAM 56, and the entering into the override area is suspended. More specifically, as the process of suspending the entering into the override area, the CPU 53 sets the suspension flag F1 to "1" and allows the suspension counter 74 to start measuring the suspended distance Ry (sheet transporting amount during the suspending).

Figure 7:
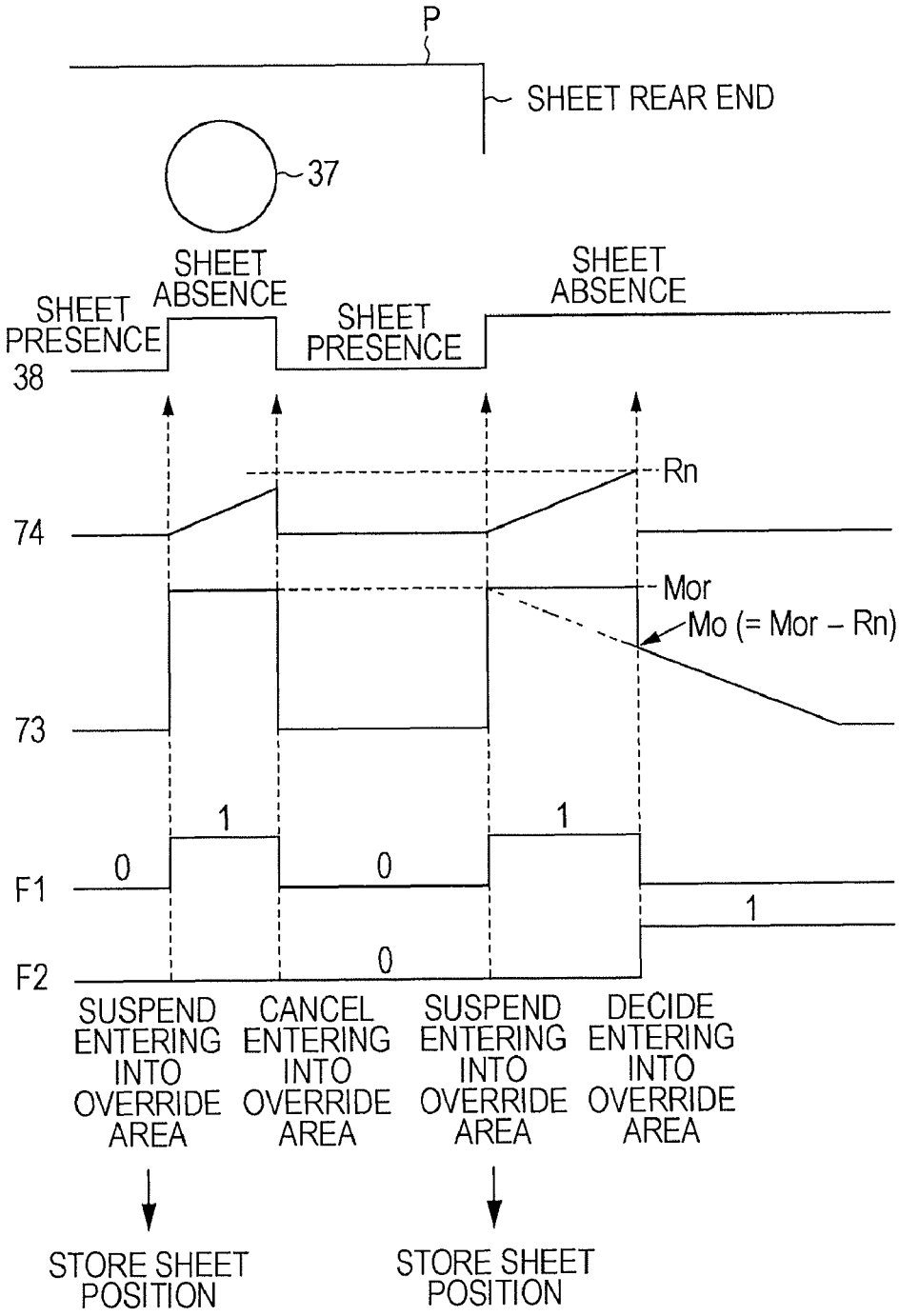
FIG. 7 is a timing chart illustrating control of distinguishing a hole from an end of the sheet.

As shown in FIG. 7, as the case where the detection state of the sheet detection sensor 38 is completely changed from the sheet presence to the sheet absence during the printing of the sheet P having holes 37, there are the case where the sheet detection sensor 38 detects an edge of the hole 37 and the case where the sheet detection sensor 28 detects the sheet rear end. In any case, if the detection state of the sheet detection sensor 38 is completely changed from the sheet presence to the sheet absence, the sheet position expressed by the counted value Ny of the position counter 71 at this time is stored in a predetermined storage area of the RAM 56, and the suspension flag F1 is set to "1".

Figure 9:
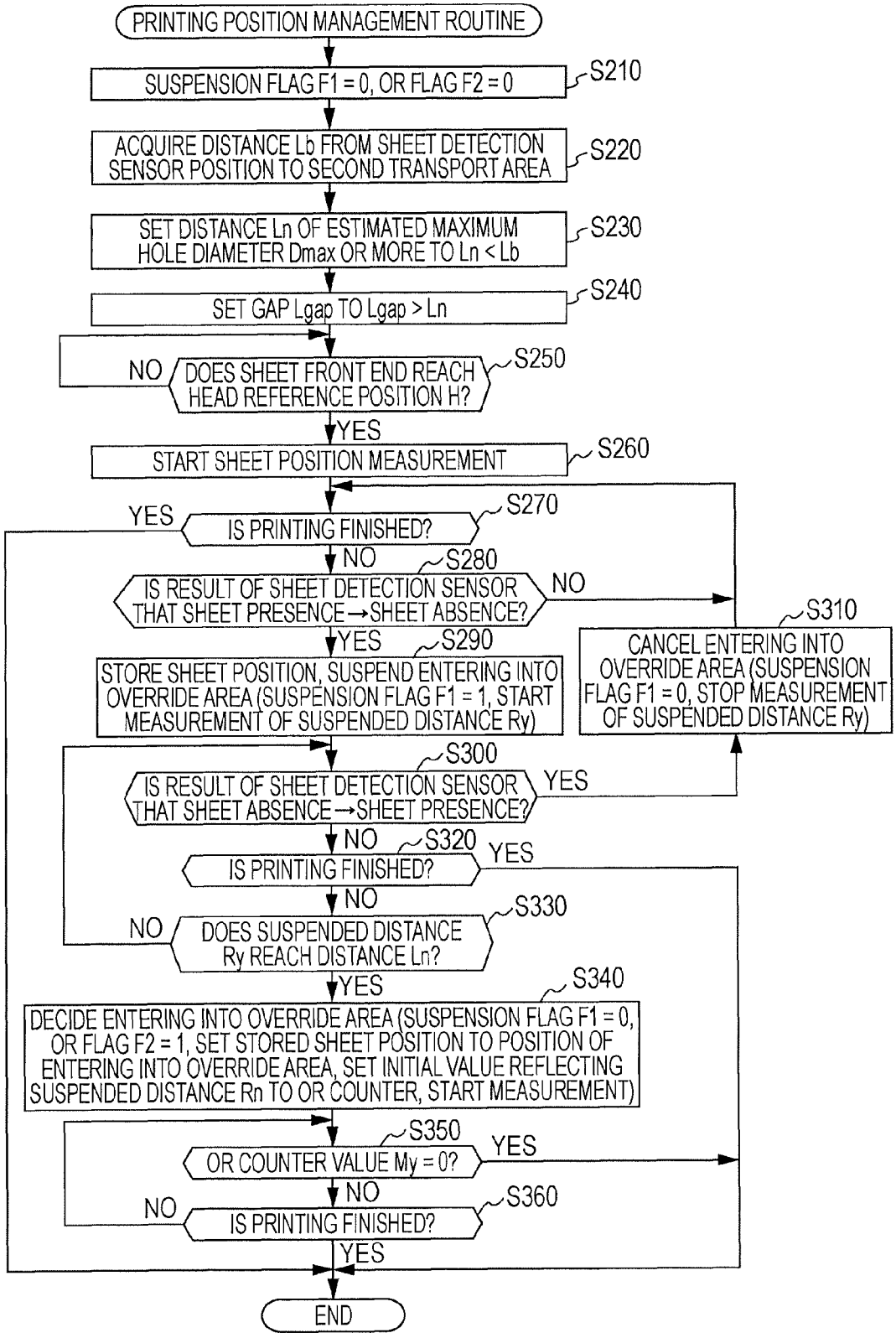
FIG. 9 is a flowchart illustrating a sheet position managing routine.
Figure 10:
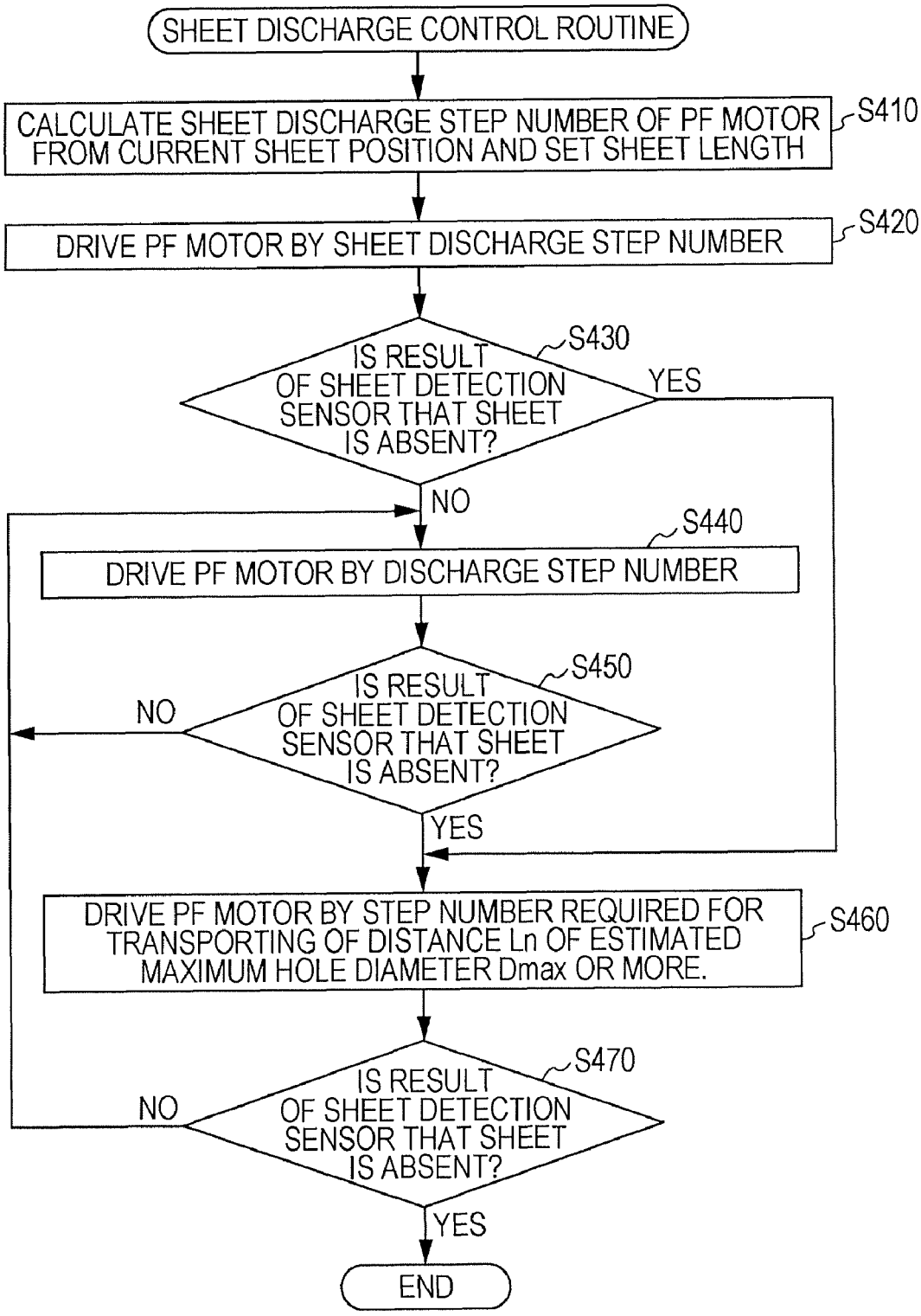
FIG. 10 is a flowchart illustrating a discharging control routine.

In Step S300 in FIG. 9, it is determined whether or not the detection state of the sheet detection sensor 38 is completely changed from the sheet absence to the sheet presence. If the detection state is completely changed to the sheet presence, the procedure proceeds to Step S310, so that the entering into the override area is cancelled. In other words, the CPU 53 sets the suspension flag F1 to "0" and resets the suspension counter 74 to stop measuring the suspended distance Ry (transporting amount). On the other hand, if the detection state is not completely changed to the sheet presence, the procedure proceeds to Step S320, so that it is determined whether or not the printing is finished. If the printing is finished, the corresponding routine is ended. On the other hand, if the printing is not finished, the procedure proceeds to Step S330.

In Step S330, it is determined whether or not the suspended distance Ry during the measurement reaches the regulated distance Ln. In other words, the CPU 53 determines whether or not the counted value of the suspension counter 74 reaches the value Rn corresponding to the regulated distance Ln. If the suspended distance Ry does not reach the regulated distance Ln, the procedure returns to Step S300, the processes of Steps S300, S320, and S330 are repeated until any one of the determination conditions is satisfied.

On the other hand, in Step S330, if it is determined that the suspended distance Ry becomes the regulated distance Ln, the procedure proceeds to Step S340, where the entering into the override area is decided. More specifically, the CPU 53 sets the suspension flag F1 to "0" and sets the OR flag F2 to "1"; and the CPU 53 reads the stored sheet position from the RAM 56 to set the sheet position as the position of the entering into the override area and to set the OR counter 73 to the initial value Mo that is reflected by the transporting amount during the suspending time interval. In other words, at the time of the entering into the override area, if the subtraction of the override value Mor is allowed to start, the obtained value of the result of the next subtraction is set to the initial value Mo(=Mor−Rn). After that, the subtraction process is allowed to start from the initial value Mo. The counted value My of the OR counter 73 is subtracted from the initial value by "1" when there is an input of a pulse edge from the encoder 68.

Herein, as shown in FIG. 7, in the suspending time interval after the detection state of the sheet detection sensor 38 is completely changed from the sheet presence to the sheet absence, the suspension counter 74 measures the sheet transporting amount (transporting distance) in the suspending time interval. At this time, the measurement process is suspended in the state that the OR counter 73 is in the override value Mor set when the detection state of the sheet detection sensor 38 is completely changed from the sheet presence to the sheet absence. In addition, in the case where the hole 37 is detected as the sheet absence, while the suspension counter 74 measures the regulated distance Ln (>estimated maximum hole diameter Dmax+α), the detection state of the sheet detection sensor 38 is completely changed from the sheet absence to the sheet presence, and at this time, the entering into the override area is cancelled. As a result, the measurement process (subtraction process) of the OR counter 73 is cancelled in the suspended state without performance.

On the other hand, as shown in FIG. 7, in the case where the sheet absence where the sheet rear end passes through a predetermined position is detected, after that, during the transporting of the sheet P by the regulated distance Ln, the suspension counter 74 completes the measurement of the regulated distance Ln in the state that the detection state of the sheet detection sensor 38 is not completely changed from the sheet absence to the sheet presence. At this time, if the counted value of the suspension counter 74 becomes the value Rn corresponding to the regulated distance Ln, the entering into the override area is decided, so that the CPU 53 reads the sheet position Ny of the time of starting the suspending the override entering from the RAM 56 and calculates a difference (=Rn) between the sheet position Ny and the sheet position Ny at the time that the override entering is decided. Next, the CPU 53 sets the OR counter 73 to the initial value Mo (=Mor−Rn), which the transporting distance Rn during the suspending time interval is reflected to, changes the suspension flag F1 from "1" to "0", and changes the OR flag F2 from "0" to "1". Next, as the transporting of the sheet P proceeds to be performed, the OR counter 73 performs a subtraction process of subtracting the transporting amount of the sheet P from the initial value Mo.

Next, returning to FIG. 9, in Step S350, it is determined whether or not the counted value My of the OR counter 73 is "0". In other words, it is determined whether or not the rear end of the sheet P reaches the printing limit position (head reference position H). If the counted value My is not "0", in the next Step S360, it is determined whether or not the printing for one page is finished. If it is determined that the printing is not finished, the procedure returns to Step S350, and the processes of Steps S350 and S360 are repeated until it is determined that the counted value My of the OR counter 73 is "0" (affirmative determination in S350) and it is determined that the printing is finished (affirmative determination in S360).

Next, if the counted value My of the OR counter 73 is "0" in Step S350, the corresponding routine is ended. On the other hand, if the printing is finished, for example, by a discharging command in Step S360, the corresponding routine is ended. The CPU 53 executes the routine every page. If there is the printing for the next page, the CPU 53 executes the routine again. In addition, in the embodiment, the transporting for the regulated distance Ln, which is performed when it is determined that the sheet detection state is the sheet presence in Step S300, corresponds to the first step, and the processed of Steps S300, S310, and S330, which are performed in the transporting interval for the regulated distance Ln, correspond to the second step. In addition, the canceling process (S310) of canceling the entering into the override area, which is performed when the sheet detection sensor 38 detects the sheet presence during the transporting for the regulated distance Ln (affirmative determination in Step S300), corresponds to a predetermined process of removing the counting process (erroneous operation) of the suspension counter that starts counting due to the detection of the hole 37.

Next, details of the discharging operation (S150) are described with reference to the flowchart of the discharging control routine shown in FIG. 10. The CPU 53 executes the routine so as to perform the discharging operation.

First, in Step S410, a discharge step number, that is, the driving amount of the PF motor 27 corresponding to the discharging distance necessary for discharge sheets is calculated from the current sheet position and the set sheet length Psize. Herein, during the suspending the override before or after the entering into the override area OR, the counted value Ny of the position counter 71 is used as the current sheet position; and after the override suspending time interval, the counted value My of the OR counter 73 is used as the current sheet position. In addition, in the embodiment, the discharging distance (discharge step number) corresponds to the discharging distance; and the CPU 53 that executes the process of Step S410 corresponds to the discharging distance acquisition unit.

In Step S420, the PF motor 27 is driven by the discharge step number. As the result of the discharging operation, the sheet P is discharged to the downstream side in the transport direction by the discharging distance regulated by the discharge step number. If the sheet length of the sheet P set by a user becomes the set sheet length Psize (set sheet size), by the discharging operation for the discharge step number, the sheet P is discharged to the discharging position where the rear end of the sheet P is located at the downstream side in the transport direction from the nip point of the discharge roller pair 36. In this case, as the result of the discharging operation for the discharge step number, the detection state of the sheet detection sensor 38 is the sheet absence. On the other hand, in the case where the sheet length of the sheet P set by the user is larger than the set sheet length Psize, after the discharging operation for the discharge step number, the sheet P may be located at the detection position of the sheet detection sensor 38. In this case, if a portion other than the hole 37 of the sheet P is located at the detection position of the sheet detection sensor 38, the detection state of the sheet detection sensor 38 is the sheet presence. If the hole 37 is incidentally located, the detection state of the sheet detection sensor 38 is the sheet absence.

In the next Step S430, it is determined whether or not the detection state of the sheet detection sensor 38 is the sheet absence. If the detection state is the sheet absence, the procedure proceeds to Step S460. If the detection state is not the sheet absence (that is, if the detection state is the sheet presence), the procedure proceeds to Step S440. Herein, if the detection state is the sheet presence, since the sheet P, of which the sheet length is larger than the set sheet length Psize, is set, the discharging is not completely finished. In addition, if the detection state is the sheet absence, there are a case where the sheet P, of which the sheet length is the set sheet length Psize, is set and the discharging is appropriately performed and a case where the sheet detection sensor 38 incidentally detects the hole 37 and the sheet P, of which the sheet length is larger than the set sheet length Psize, is set, so that the discharging is not completely finished actually.

In Step S440, the PF motor 27 is driven by a regulated discharge step number necessary to discharge the sheet. Herein, the regulated discharge step number is a driving step number of the PF motor 27 corresponding to the regulated discharging distance (predetermined distance) which is larger than the distance in the transporting path from the sheet detection sensor 38 to the discharge roller pair 36 by a predetermined margin distance. The regulated discharge step number is a driving step number which, after the once discharging operation for the discharge step number, can discharge the sheet, which is detected as the sheet presence, to a position at the downstream side in the transport direction from the nip point of the discharge roller pair 36. The predetermined margin distance is set to a predetermined value in a range of, for example, 1 to 10 cm.

In Step S450, it is determined whether or not the detection state of the sheet detection sensor 38 is the sheet absence. If the detection state is the sheet absence, the procedure proceeds to Step S460. If the detection state is not the sheet absence (that is, if the detection state is the sheet presence), the procedure returns to Step S440. In other words, if the detection state is the sheet presence, the PF motor 27 is driven again by the regulated discharge step number, so that the sheet is discharged by the regulated discharging amount, and the driving of the PF motor 27 by the regulated discharge step number in Step S440 is repeated until the sheet absence state is detected in Step S450. However, in a normal case, the sheet is discharged by once discharging operation for the regulated discharging distance, and after the discharging operation, the detection state of the sheet detection sensor 38 becomes the sheet absence.

Herein, after the driving of the PF motor 27 for the discharge step number, in the case where the detection state of the sheet detection sensor 38 is the sheet presence and in the case where the detection state of the sheet detection sensor 38 is the sheet absence according to the detection of the hole 37, the discharging operation for the discharge step number becomes an erroneous operation. In addition, after the first discharging operation, after the PF motor 27 is further driven at least one time by the regulated discharge step number, even though the detection state of the sheet detection sensor 38 is the sheet absence, the discharging operation may not completely finished according to the detection of the hole 37 by the sheet detection sensor 38 in an actual case. In the case where if the detection state of the sheet detection sensor 38 is the sheet absence, it is to be identified whether the detection state of the sheet absence is the case where rear end of the sheet passes through a predetermined position or the case where the sheet detection sensor 38 incidentally detects the hole 37.

Next, in Step S460, the PF motor 27 is driven by a regulated step number necessary for the transporting of the regulated distance Ln (=Dmax+$\alpha$), that is, the estimated maximum hole diameter Dmax or more. For example, in the case where the determination of the sheet absence in Step S430 or S450 is based on the detection of the hole 37, if the PF motor 27 is driven by the regulated step number in Step S460 so that the sheet P is transported by the regulated distance Ln, the detection state of the sheet detection sensor 38 becomes the sheet presence. On the other hand, in the case where the determination of the sheet absence in Step S430 or S450 is based on the fact that the sheet P is already discharged, even if the PF motor 27 is driven by the regulated step number so that the sheet P is transported by the regulated distance Ln, the detection state of the sheet detection sensor 38 becomes the sheet absence.

In Step S470, it is determined whether or not the detection state of the sheet detection sensor 38 is the sheet absence. For example, after the first discharging operation (S420) is ended, after the transporting of the regulated distance Ln is performed (S460), if the detection state of the sheet detection sensor 38 is the sheet absence, the first discharging operation is a normal operation, and the sheet is correctly discharged. In this case, the corresponding routine is ended. On the other hand, after the first discharging operation (S420) is ended, after the transporting of the regulated distance Ln is performed (S460), if the detection state of the sheet detection sensor 38 is the sheet presence, the first discharging operation is an erroneous operation, and the sheet is not correctly discharged. In this case, the procedure returns to Step S440, so that the discharging operation for the predetermined distance is performed by driving the PF motor 27 by the discharge step number in order to remove the state of the erroneous operation (for example, the state where the sheet is nipped by the discharge roller pair 36) where the sheet is not correctly discharged.

On the other hand, after the first discharging operation is ended (S420), the sheet presence is detected. After the discharging operation for the predetermined distance (second discharging operation) is performed (S440), after the transporting for the regulated distance Ln is performed (S460), if the detection state of the sheet detection sensor 38 is the sheet absence, it is determined that the sheet is correctly discharged by the second discharging operation. In this case, the corresponding routine is ended. In addition, after the discharging operation for the predetermined distance (second discharging operation), after the transporting for the regulated distance Ln is performed (S460), if the detection state of the sheet detection sensor 38 is still the sheet presence, the procedure returns to Step S440, so that the processes of Steps S440 to S470 are repeated until the sheet absence is detected in Step S470. In other words, the discharging operation for the predetermined distance (S440), the determination of the sheet absence (S450), the transporting for the regulated distance Ln (S460), and the determination of the sheet absence (S470) are repeated until the determination of the sheet presence is obtained in Step S470.

Therefore, in the case of printing a sheet P having holes 37, although a user sets the sheet P having a size larger than the set sheet length Psize, the sheet P can be securely discharged after the printing thereof. In addition, in the embodiment, the process of Step S460 corresponds to the transporting step; the process of Step S470 corresponds to the determination step; and the process of the Step S440 and the process of ending the discharging control routine at the time when the sheet absence is detected in Step S470 correspond to the third step.

As described above, according to the embodiment, the following advantages can be obtained.

(1) Although the detection state of the sheet detection sensor 38 is completely changed from the sheet presence to the sheet absence, the measuring process of the OR counter 73 as the measuring unit is suspended. After that, if the detection state of the sheet detection sensor 38 is the sheet presence during the transporting for the regulated distance Ln, the performance of the suspended measuring process of the OR counter 73 is cancelled. On the other hand, if the transporting for the regulated distance Ln is finished without detection of the sheet presence by the sheet detection sensor 38 during the transporting, the suspended measuring process of the OR counter 73 is allowed to be performed. Therefore, for example, although the detection state of the sheet detection sensor 38 becomes the sheet absence by the detection of the filling hole 37, the measuring process (subtraction process) of the OR counter 73 is not performed. On the other hand, in the case where the detection state of the sheet detection sensor 38 becomes the sheet absence by the detection of the rear end of the sheet P, the measuring process of the OR counter 73 is performed after the elapse of the suspending time interval where the transporting for the regulated distance Ln is finished. Therefore, in the case where the sheet detection sensor 38 detects the hole 37, the measuring process of the OR counter 73 is not allowed to start. In this manner, in the case where the measuring process of the OR counter 73, which is suspended when the detection state of the sheet detection sensor 38 is completely changed from the sheet presence to the sheet absence, is erroneously operated due to the detection of the hole 37, the canceling process (predetermined process) is performed, so that the erroneous operation can be avoided from being performed. On the other hand, in the case of a normal operation according to the detection of the rear end of the sheet, the canceling process is not performed, and the normal measuring process can be performed. Therefore, in the case where an edge of the hole 37 is detected, since the measuring process of the OR counter 73 is not performed, the edge of the hole 37 is detected, and the measuring process of the measuring unit is allowed to start, so that an erroneous operation of the printer 11, which is based on an incorrectly measured value in the related art, such as the changing from the first transporting control to the second transporting control can be avoided based on the measured value of the measuring unit.

(2) The regulated distance Ln is set to the value of the estimated maximum hole diameter Dmax or more. Therefore, in the case where the detection state of the sheet detection sensor 38 is completely changed from the sheet presence to the sheet absence due to the hole 37, the measuring process of the OR counter 73 can be securely cancelled. On the other hand, in the case where the detection state of the sheet detection sensor 38 is completely changed from the sheet presence to the sheet absence due to the detection of the rear end of the sheet P, the measuring process of the OR counter 73 can be securely performed.

(3) The regulated distance Ln is set to a value (Ln<Lb) which is smaller than a distance Lb in the transporting path from the detection position (predetermined position) of the sheet detection sensor 38 to the nip point of the sheet transport roller pair 35. Accordingly, before the rear end of the sheet reaches the nip point of the discharge roller pair 36, the suspension is released, and the measuring process is allowed to start from the initial value Mo where the suspended transporting amount of the OR counter 73 is reflected. Therefore, the CPU 53 can determines based on the counted value of the OR counter 73 that the rear end of the sheet P reaches the position (nip point of the sheet transport roller pair 35) due to the completely changing from the first transport area to the second transport area. Therefore, in the first transport area where the sheet P is nipped by the sheet transport roller pair 35 and the discharge roller pair 36, the sheet P can be transported in the first transporting control; and in the second transport area where the sheet P is nipped only by the discharge roller pair 36, the sheet P can be transported in the second transporting control. As a result, between the case where the position of the rear end of the sheet P is in the first transport area and the case where the position of the rear end of the sheet P is in the second transport area, a difference in the position of the printing cannot easily occur, so that high-quality printing can be performed.

(4) The regulated amount Lgap which regulates the minimum value of the interval between the preceding sheet P1 and the following sheet P2 is set to a value (Lgap>Ln) which is larger than the regulated distance Ln. Accordingly, the hole 37 is distinguished from the interval, and when the edge of the hole 37 is detected, the measuring process of the OR counter 73 is cancelled; and if the rear end of the preceding sheet P1 is detected, the measuring process of the OR counter 73 can be performed. Therefore, the determination of the interval between the sheets P1 and P2 as the hole 37 and the canceling of the measuring process of the OR counter 73 can be avoided. Moreover, the printing on the platen 20 which is caused from the erroneous determination of the interval as the hole 37 and the canceling the measuring process can be avoided.

(5) After the discharging operation (first discharging operation) for the discharging distance, which is calculated from the position of the sheet at the time of starting discharging the sheet and the set sheet length Psize, is performed, although the sheet detection sensor 38 detects the sheet absence, the transporting for the regulated distance Ln is further performed. Next, the discharging operation for the regulated distance Ln is finished, if the detection state of the sheet detection sensor 38 is the sheet presence, the first discharging operation is an erroneous operation where the discharging distance is erroneous, and the discharging operation for a predetermined distance as the predetermined process is performed so as to remove the an erroneous operation state (for example, a state where the sheet is nipped by the discharge roller pair 36). On the other hand, if the detection state of the sheet detection sensor 38 is the sheet absence, the discharging operation for the predetermined distance is not performed. Next, in the case where the discharging operation for the predetermined distance is performed, when the sheet absence is determined after the discharging operation for the predetermined distance is finished, the transporting for the regulated distance (S460) and the discharging operation for the predetermined distance (S440), which is to be performed when the sheet presence is determined after the transporting for the regulated distance, are repeated until the sheet absence is determined after the transporting for the regulated distance. Therefore, for example, even in the case where the user sets a sheet P, which is longer than the set sheet length Psize, the sheet P of which the printing is finished can be securely discharged. Accordingly, the sheet that is securely discharge can be avoided from being in the state (erroneous operation state) that the sheet is nipped by the discharge roller pair 36. For example, it is possible to solve a problem such as breakage of the sheet P caused when the user forcibly extracts the sheet P that is nipped by the discharge roller pair 36.

Second Embodiment

Figure 11:
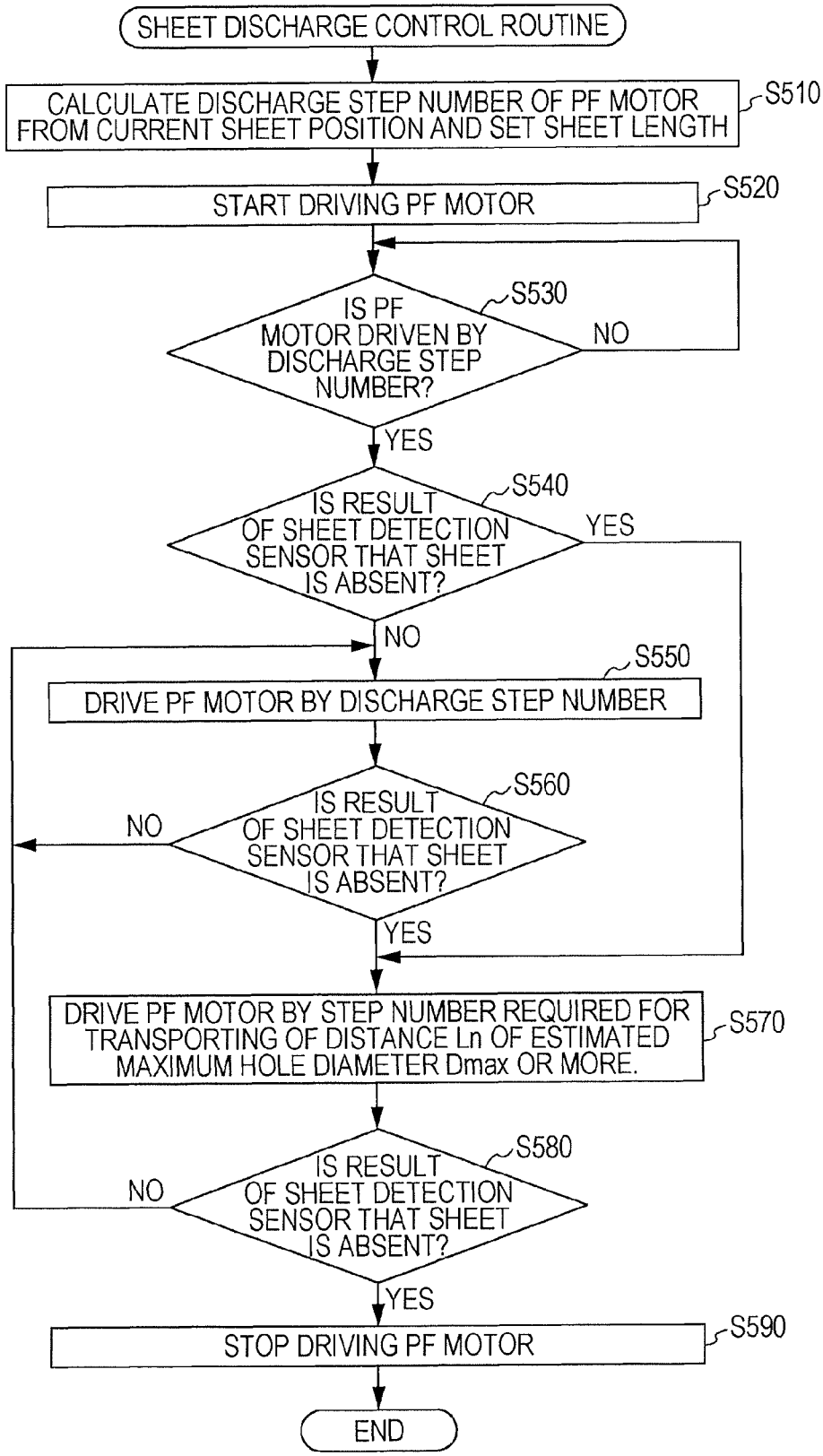
FIG. 11 is a flowchart illustrating a discharging control routine according to a second embodiment.

Next, a second embodiment is described. The embodiment is another example of the discharging control routine. Hereinafter, the discharging control routine is described with reference to a flowchart in FIG. 11. In the aforementioned first embodiment, when the first discharging operation, the transporting operation for the regulated distance, and the discharging operation for the predetermined distance, are performed, the driving of the PF motor 27 is stopped at every time. However, in the embodiment, the discharging is completed by the one-time driving of the PF motor 27 without temporary stop of the driving of the PF motor 27. When the discharging operation (S150) in FIG. 9 is performed, the CPU 53 executes a discharging control routine in FIG. 11.

First, in Step S510, the discharge step number of the PF motor 27 is calculated from the current sheet position and the set sheet length Psize. Next, the CPU 53 starts driving of the PF motor 27 (S520). If the driving is performed by the discharge step number (affirmative determination in Step S530), the CPU 53 determines whether or not the detection state of the sheet detection sensor 38 is the sheet absence (S540). At this time, if the detection state of the sheet detection sensor 38 is the sheet absence (affirmative determination in Step S540), the PF motor 27 is further driven 7 by a regulated discharge step number necessary for the transporting for the regulated distance Ln (Dmax+$\alpha$) of the estimated maximum hole diameter Dmax or more (S570).

Next, at the time when the driving amount of the PF motor 27 becomes the regulated discharge step number, it is determined whether or not the detection state of the sheet detection sensor 38 is the sheet absence. If the sheet absence is determined (affirmative determination in Step S580), the driving of the PF motor 27 is stopped. For example, in the case where a user sets a sheet P having a sheet length that is the set sheet length Psize, an appropriate discharge step number (discharging distance) capable of discharging the sheet is calculated from the sheet position at the time of starting discharging the sheet and the set sheet length Psize. The first discharging operation with the appropriate discharging distance is a normal operation.

For example, in the case where the user sets a sheet P which is longer than the set sheet length Psize, the discharge step number (discharging distance) that is calculated from the sheet position at the time of starting discharging the sheet and the set sheet length Psize is an incorrect value where the sheet cannot be completely discharged. The first discharging operation with the incorrect discharging distance is an erroneous operation where the sheet cannot be completely discharged. In this case, at the time of driving by discharge step number, there are a case where the sheet detection sensor 38 detects the sheet P and the sheet presence is determined and a case where the sheet detection sensor 38 incidentally detects the hole 37 of the sheet P and the sheet absence is determined.

In the latter case where the sheet absence is determined (affirmative determination in Step S540), in Step S570, the driving of the PF motor 27 further continues to be performed by the regulated step number. At the time when the driving amount is the regulated step number, the detection state of the sheet detection sensor 38 is determined to be the sheet presence (negative determination in Step S580). This is the same state as the sheet presence detection state of the former case.

The case where the detection state of the sheet detection sensor 38 is determined to be the sheet presence at the time of discharging the sheet by the first discharging distance (discharge step number) (negative determination in Step S540) and the case where the detection state is determined to be the sheet presence at the time of discharging the sheet by the first discharging distance and the detection state is determined to be the sheet absence after the transporting for the regulated distance Ln further continues to be performed (negative determination in Step S580) are the cases where the first discharging operation is an erroneous operation where the discharging distance is incorrect. In this case, in Step S550, in order to remove the erroneous operation state (for example, a case where the sheet is nipped by the discharge roller pair 36), the driving of the PF motor 27 as a predetermined process further continues to be performed, so that the discharging operation with a predetermined distance further continues to be performed.

In the case where the discharging operation with a predetermined distance further continues to be performed (S550), it is determined whether or not the detection state is the sheet absence at the time of the predetermined distance (S560). If the detection state is determined to be the sheet absence, the continuous performance of the transporting for the regulated distance (S570) and the determination process at the time of the regulated distance (S580) are performed. If the detection state is determined to be the sheet absence in Step S580, the driving of the PF motor 27 is allowed to stop (S590). On the other hand, if the detection state is determined to be the sheet presence in Step S580, the continuous performance of the discharging operation with a predetermined distance (S550), the determination of the sheet absence at the time of the regulated distance (S560), and the continuous performance of the transporting operation for the regulated distance (S570), which is to be performed when the sheet absence is determined in Step S560, are repeated until the sheet absence is determined in Step S580. Next, if the sheet absence is determined in Step S580, the driving of the PF motor 27 is allowed to stop. In addition, in the embodiment, the process of Step S570 corresponds to the transporting step; the process of Step S580 corresponds to the determination step; and the processes of Steps S550 and S590 correspond to the third step.

Therefore, according to the second embodiment, for example, even in the case where a user sets a sheet which is longer than the set sheet length Psize, the sheet can be securely discharged by one-time discharging operation to the position where the sheet P is not nipped by the discharge roller pair 36 without interim stop of the driving of the PF motor 27.

The invention is not limited to the aforementioned embodiments, but the following modified examples may be employed.

Modified Example 1

In the sheet position managing routine (FIG. 9) according to the first embodiment, when the sheet absence is detected (affirmative determination in Step S280), before the transporting for the regulated distance, which is the diameter of the hole or more, is finished (affirmative determination in Step S330), if the sheet detection sensor 38 detects the sheet presence (affirmative determination in Step S300), a canceling process of the measuring unit as a predetermined process is performed (S310). As an alternative configuration, when the sheet absence is detected (affirmative determination in Step S280), after the transporting for the regulated distance, which is the diameter of the hole or more, is finished (affirmative determination in Step S330), the sheet presence or the sheet absence may be determined by the sheet detection sensor 38, and if the sheet presence is determined, the canceling process of the measuring unit as a predetermined process may be performed (S310). In this case, when the transporting for the regulated distance is finished (affirmative determination in Step S330), if the sheet detection sensor 38 detects the sheet absence, the suspended measuring process of the measuring unit is allowed to be performed with a value where the suspended transporting amount is reflected. In this manner, it is determined whether or not to be the sheet absence after the transporting for the regulated distance, and if the sheet presence is determined, a predetermined process (for example, the canceling process) may be performed. In this configuration, although the time of performing the predetermined process is slightly late, the same advantage can be obtained.

Modified Example 2

In the discharging control routines according to the first and second embodiments, when the sheet absence is detected (affirmative determination in Steps S430 and S540), after the transporting for the regulated distance which is the diameter of the hole or more (S460 and S570), the medium presence or absence is determined (S470 and S580). As alternative configuration, when the sheet absence is detected (affirmative determination in Steps S430 and S540), the transporting for the regulated distance, which is the diameter of the hole or more, is allowed to start, and when the sheet detection sensor 38 detects the sheet presence during the transporting for the regulated distance, the procedure proceeds to Steps S440 and S550. On the other hand, in the case where the transporting for the regulated distance is finished without interim detection of the sheet presence by the sheet detection sensor 38 (affirmative determination in Steps S470 and S580), the discharging control routine may be ended (in the case of the first embodiment), or the driving PF motor 27 may be allowed to stop (in the case of the second embodiment). According to the configuration, the same advantages as those of the aforementioned embodiments can be obtained, and in the case where the hole is detected during the transporting for the regulated distance, the discharging operation can be allowed to start speedily, so that the discharging operation can be easily ended in earlier time. In addition, even in the case where, after the sheet presence is detected during the transporting for the regulated distance, the sheet absence is detected again at the ending time of the transporting for the regulated distance, the sheet can be securely discharged by performing the discharging operation for the predetermined distance at the time of interim detection of the sheet presence.

Modified Example 3

The regulated distance Ln, which is used to determine a suspending section where the performance the measuring process of the measuring unit is suspended, may be suitably changed. In a configuration where the transporting control is not changed, a distance slightly smaller than Lor may be set to the regulated distance, and the measuring process of the OR counter 73 may be allowed to be performed slightly before the sheet rear end reaches the recording limit position. In this case, the configuration where the transporting control is changed may be used. For example, the sheet position in the suspending time interval is acquired based on the counted value of the position counter 71, and the changing of the transporting control may be performed based on the counted value.

Modified Example 4

In the aforementioned embodiments, the OR counter 73 is set to the override value Mor when the sheet detection sensor 38 detects the sheet absence. As an alternative configuration, the OR counter 73 may be reset ("0"), and at the time of releasing the suspending, the OR counter 73 may be set to the initial value Mo.

Modified Example 5

The setting unit is not limited to the configuration where the regulated distance is smaller than a distance in the transporting path from the predetermined position (the position where the detection unit detects the medium) to the second section (second transport area). Although the performance of the measuring process of the measuring unit may be suspended, if the erroneous operation of the recording apparatus does not occur, the regulated distance may be set to a suitable value. For example, in a configuration where the first transport area and the second transport area are employed as common transporting control, the regulated distance Ln may be set to be longer than the distance Lb in the transporting path from the predetermined position to the nipped point of the sheet transport roller pair 35 and to be smaller than the OR distance Lor. Accordingly, at the same timing when it is determined from the counted value of the measuring unit (OR counter 73) that the rear end of the sheet reaches the recording limit position, the suspension is released, and the measuring process of the measuring unit may be allowed to start.

Modified Example 6

The suspension counter 74 may be removed, but the suspending function may be provided to the position counter 71.

For example, the sheet position of the time when the sheet absence is detected is stored, and when a difference between the current sheet position determined from the counted value of the position counter 71 and the stored sheet position becomes a value corresponding to the regulated distance Ln, it may be determined that the suspending section is ended. Next, the OR counter 73 may be set to the initial value where the transporting amount of the suspension is reflected, and the measuring process may be allowed to start.

Modified Example 7

As an alternative configuration, the OR counter may perform the measurement of the suspending section. As another alternative configuration, when the sheet presence is detected until the OR counter finishes measuring the regulated distance, the OR counter may be reset. In this case, since the regulated distance is set to be smaller than the distance to the first transport area by the first setting unit, when the hole is detected, the changing of the transporting control may not be performed, but when the end of the sheet is detected, the changing of the transporting control may be performed.

Modified Example 8

The hole diameter is not limited to the estimated maximum hole diameter. In the case where the hole diameter is known, the known hole diameter may be used.

Modified Example 9

The predetermined position of the sheet detection sensor may be at the upstream side in the transport direction from the recording head. For example, the predetermined position may be at the downstream side of the sheet transport roller pair 35. In this case, the sheet detection sensor is disposed at a position just after the sheet transport roller pair 35 in the transport direction. From the time when the detection state of the sheet detection sensor 38 is completely changed from the sheet presence to the sheet absence until the transporting for the regulated distance is finished, the suspending state is maintained. As an alternative configuration, at the time when the transporting for the regulated distance is finished without detection of the sheet presence, so that it is determined that it is not a hole, the first transporting control may be changed to the second transporting control.

Modified Example 10

In the configuration where only the discharging control routine (FIGS. 10 and 11) is employed, the predetermined position of the sheet detection sensor may be at the downstream side in the transport direction from the recording head. In this case, the perforated medium can also be securely discharged.

Modified Example 11

The detection unit is not limited to the transmission type sensor. The detection unit may be a reflection type sensor which receives the light reflected from the sheet to detect the sheet presence. Moreover, a distance sensor may be used. In addition, the detection unit is not limited to the optical sensor, but, for example, a mechanical sensor such as a contact type sensor may also be used. In addition, the detection unit is not limited to the configuration where the detection unit is disposed at an end position in the sheet width. For example, if a plurality of sheet having different sheet sizes can be detected, the sheet detection sensor may be disposed, for example, at a central position in the sheet width. Moreover, the detection unit may be a sensor provided to the carriage. Although these different type sensors are employed, it is possible to remove the erroneous operation when the hole is detected as the sheet absence.

Modified Example 12

The interval detection unit may be configured to include a sensor disposed in the vicinity of the sheet feed inlet so that it can be detected whether or not the interval of the regulated amount Lgap or more is ensured. For example, a sensor which detects whether or not the rear end of the preceding sheet P1 passes through the feed starting position G may be provided. If the sensor detects the rear end of the preceding sheet P1, the feeding of the following sheet P2 may be allowed to start.

Modified Example 13

The hole is not limited to the filling hole. For example, the hole may be a hole, of which the maximum width is smaller than the distance Lb. The shape of the hole is not limited to a circle, but a polygonal hole (a triangular hole, a rectangular hole, a hexagonal hole, or the like), an elliptical hole, a slit, or the like.

Modified Example 14

The medium is not limited to the sheet. Films or metal thin plate (for example, metal foil) may also be used.

Modified Example 15

The recording apparatus is not limited to a serial printer, but a line printer or a page printer may be used. In addition, the recording apparatus may be a multifunctional apparatus. In addition, the printing type is not limited to an ink jet type, but a dot impact type or a thermal transfer type, or a laser type may be employed. In addition, in the ink jet type recording apparatus, there may be included an industrial liquid ejecting unit which sprays a liquid material on a substrate to form a color filter, an organic EL display, or the like, an ink jet type textile printer.

Other Embodiments

Figure 12:
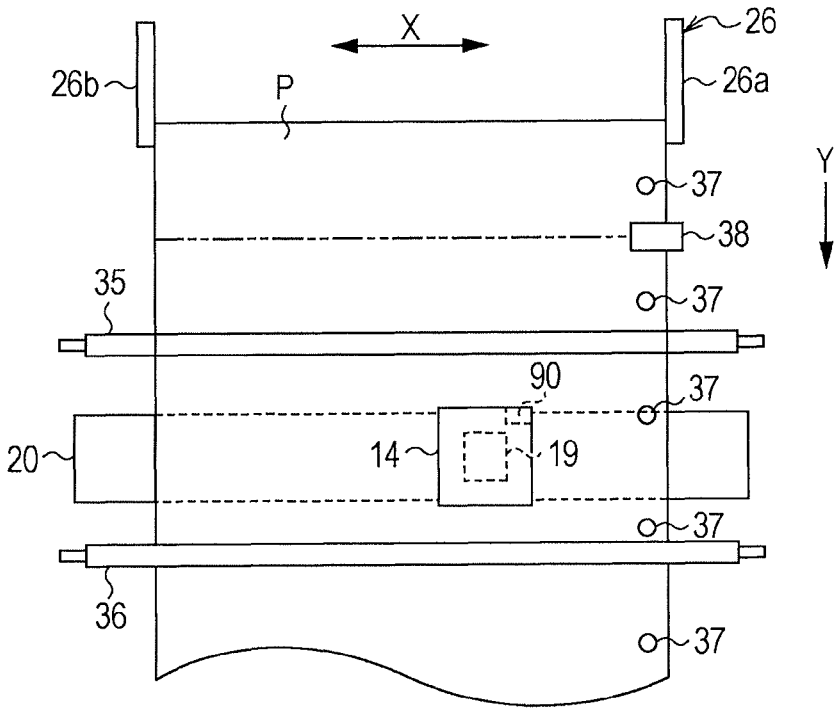
FIG. 12 is a diagrammatic plan view illustrating main components of a printer according to modified example.
Figure 13:
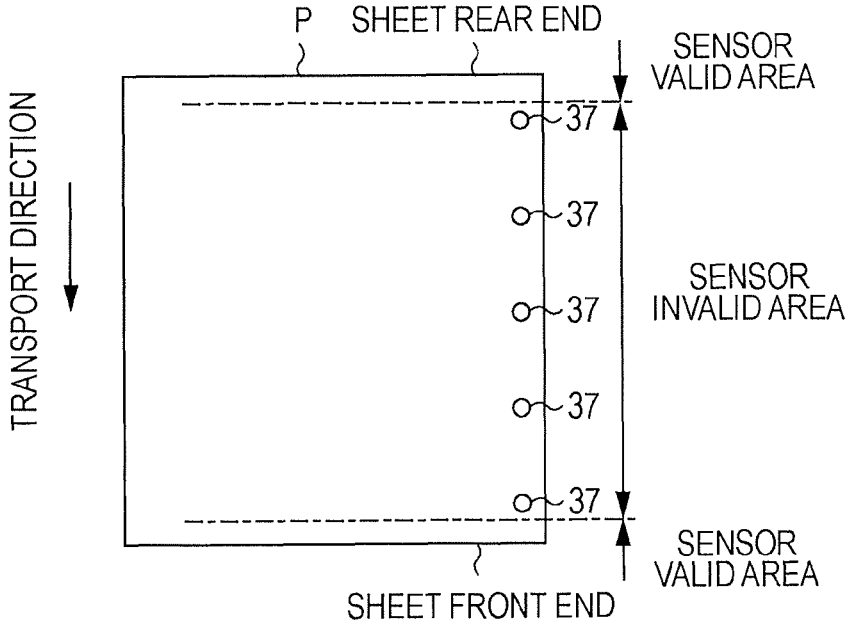
FIG. 13 is a diagrammatic plan view of a sheet for explaining detailed processes.

Hereinafter, other embodiments capable of implementing the invention are described. FIG. 12 is a schematic side plan view of a printer, and FIG. 13 is a plan view of a sheet at the time of printing. As shown in FIG. 13, in the printer 11 according to the embodiment, a sheet width sensor 90 is provided to a carriage 14.

The sheet width sensor 90 is constructed with, for example, a reflection type optical sensor (photosensor). The sheet width sensor 90 is disposed at a position of the upstream side in the transport direction from the recording position in the recording head 19 so that the position of the upstream side from the printing position of the sheet P is to be detected. The sheet width sensor 90 is a type of detecting the sheet by using the fact that, if the projecting light collides on a white portion of the sheet P, the receiving amount of the reflected light is relatively increased. Therefore, if the receiving amount of the reflected light from the sheet P exceeds a predetermined level, the sheet width sensor 90 turns on; and if the receiving amount of the reflected light is less than the predetermined level when the sheet P is not in the detection area, sheet width sensor 90 turns off.

When the carriage 14 (recording head 19) is reciprocatingly moved in the main scan direction X, the sheet width sensor 90 detects the two ends (side ends) of the sheet P in the width direction, so that the CPU 53 acquires the distance between the detected two points in the X direction as the sheet width of the sheet P. In addition, if the sheet width sensor 90 is in the non-detection state in a range which exceeds the regulated distance Lw of the estimated maximum hole diameter Dmax or more in the sheet width area, the CPU 53 determines that the rear end of the sheet P reaches the detection position of the sheet width sensor 90. When the range where the sheet width sensor 90 is in the non-detection state is equal to or less than the regulated distance Lw, the CPU 53 considers that the non-detection state is due to the existence of the hole 37 at the detection position.

The CPU 53 calculates the position of the rear end of the sheet P from the set sheet length Psize and the sheet position Ny of the position counter 71. After the sheet detection sensor 38 detects the front end of the sheet P (sheet absence->sheet presence), the CPU 53 sets the area, where a partial area of the front end side of the sheet in the transport direction and a partial area of the rear end side as shown in FIG. 13 is excluded, as the sensor invalid area where the detection of the sheet detection sensor 38 is allowed to be invalid. In other words, during the time when the counted value of the position counter 71 that is allowed to start by detection of the front end of the sheet P during the feeding by the sheet detection sensor 38 (sheet absence->sheet presence) is the received value when the sheet detection sensor 38 detects a partial area of the front end side of the sheet, the sheet detection sensor 38 is allowed to be valid. If the counted value deviates from the partial area of the front end side, the sheet detection sensor 38 is allowed to be invalid. After that, if the front end of the sheet P reaches the head reference position H, so that the counted value of the once reset position counter 71 becomes the value when the sheet detection sensor 38 starts detecting the partial area at the rear end side of the sheet P, the sheet detection sensor 38 is allowed to be valid again.

However, although the sheet P is in the invalid area of the sheet detection sensor 38, if the non-detection state is detected in the range where exceeds the regulated distance Lw in the sheet width area, so that the CPU 53 determines that the rear end of the sheet P reaches the detection position of the sheet width sensor 90, the OR counter 73 starts counting. In this case, if the counted value of the OR counter 73 becomes the value corresponding to the distance in the transporting path from the detection position of the sheet width sensor 90 to the head reference position H, the CPU 53 performing control of forcibly stopping the ejection of the ink droplets from the recording head 19 and discharging the sheet P, so that the ejection of the ink depletes on the platen 20 can be prevented.

Figure 14:
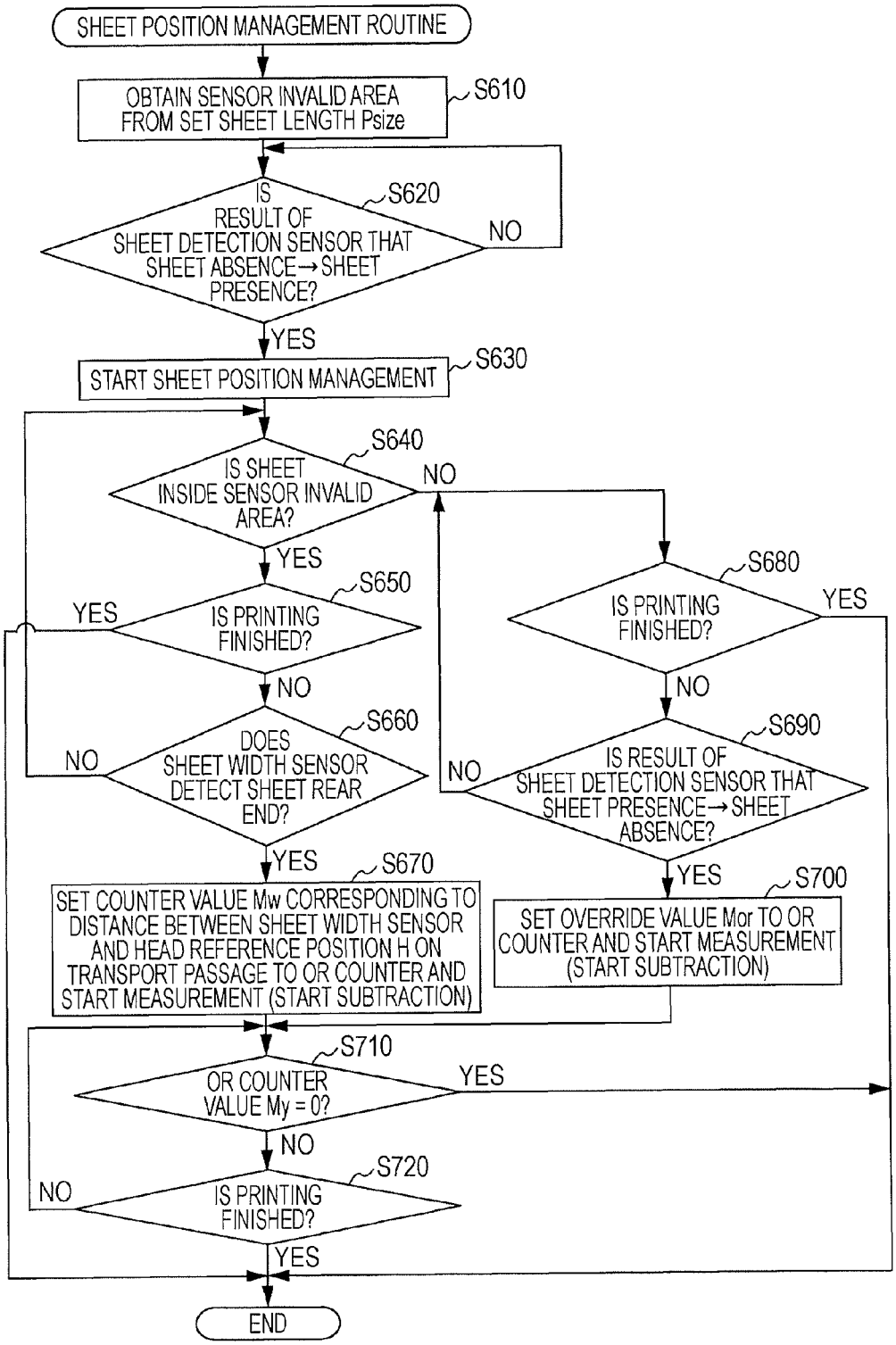
FIG. 14 is a flowchart illustrating a sheet position managing routine.

FIG. 14 illustrates a flowchart of the sheet position managing routine in the example. The CPU 53 executes this routine together with the printing control routine in FIG. 8. First, the sensor invalid area is obtained from the set sheet length Psize (S610). The feeding is allowed to start, and if the detection state of the sheet detection sensor 38 is completely changed from the sheet absence to the sheet presence (affirmative determination in Step S620), the position counter 71 is reset to start the measurement (management) of the sheet position (S630). Next, if the sheet enters into the sensor invalid area (affirmative determination in Step S640), the determination whether or not the printing is finished (S650) and the determination whether or not the sheet width sensor 90 detects the rear end of the sheet (S660) are repeated.

In the case where a user sets a sheet which is smaller than the set sheet length Psize, if the printing is not finished in the sensor invalid area, the rear end of the sheet is detected by the sheet width sensor 90 at the time when the sheet is in the sensor invalid area (affirmative determination in Step S650). In this case, in Step S670, the CPU 53 allows the OR counter 73 to be set to a counted value Mw corresponding to a distance in the transporting path between the sheet width sensor 90 and the head reference position H and allows the measurement (subtraction) of the transporting amount of the sheet to start. Next, if the value My of the OR counter 73 is "0" (S710 and S110 in FIG. 8), the printing is forcibly finished, and the discharging operation is performed (S150 in FIG. 8).

On the other hand, in the case where the user sets a sheet P of the set sheet length Psize, if the printing is not finished in the sensor invalid area, the sheet is allowed to enter into the sensor valid area without detection of the sheet rear end in the sensor invalid area by the sheet width sensor 90 (negative determination in Step S640), the determination whether or not the printing is finished in the sensor valid area (S680) and the determination whether or not the detection state of the sheet detection sensor 38 is completely changed from the sheet presence to the sheet absence (S690) are repeated. In the case where the printing is not finished in the sensor valid area, if the detection state of the sheet detection sensor 38 is completely changed from the sheet presence to the sheet absence (affirmative determination in Step S690), the OR counter 73 is set to the override value Mor corresponding to the distance in the transporting path between the sheet detection sensor 38 and the head reference position H, and the measurement (subtraction) of the sheet position is allowed to start (S700). Next, if the value My of the OR counter 73 is "0" (S710 and S110 in FIG. 8), the printing is forcibly finished, and the discharging operation is performed (S150 in FIG. 8). In addition, when the printing is finished in the sensor invalid area (affirmative determination in Step S650), or when the printing is finished in the sensor valid area (affirmative determination in Step S680), the discharging operation (S150 in FIG. 8) is also performed.

When the sheet is in the sensor invalid area, the hole 37 is at the detection position of the sheet detection sensor 38; and although the detection state of the sheet detection sensor 38 is completely changed from the sheet presence to the sheet absence, the sheet detection sensor 38 is considered to be invalid, so that it is avoided that the hole 37 is erroneously detected as the sheet rear end. Next, if the area where the hole 37 exists in the transport direction of the sheet passes through the detection position of the sheet detection sensor 38, the sheet enters into the sensor valid area. Since the sheet detection sensor 38 is considered to be valid, the rear end of the sheet can be detected, so that the sheet discharging can be performed. In addition, the discharging operation is performed by the CPU 53 executing the discharging control routine in FIG. 10 or 11.

Figure 8:
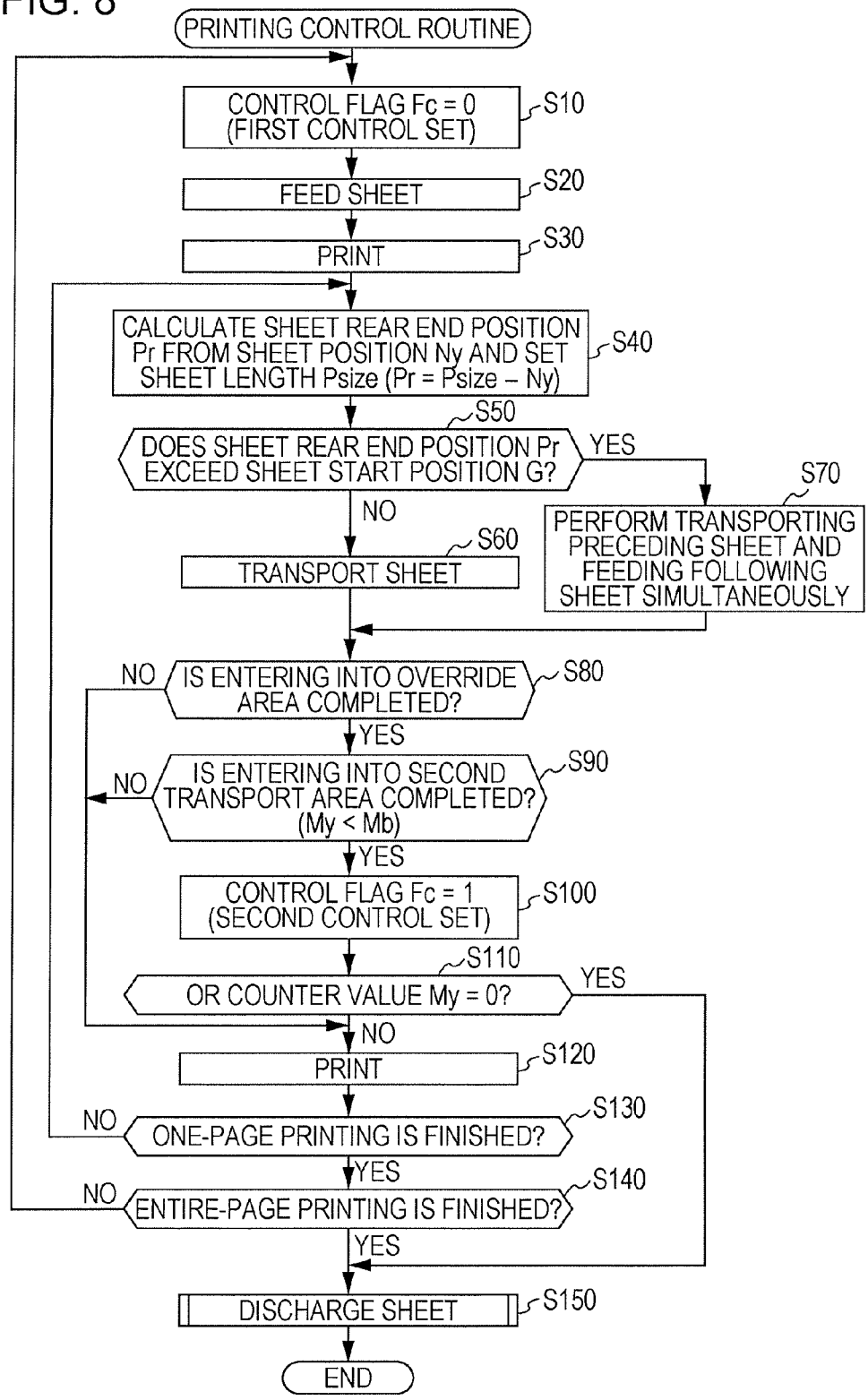
FIG. 8 is a flowchart view illustrating a printing control routine.

In addition, in Step S90 in FIG. 8, if the entering into the second transport area is completed (My<Mb), the transporting control flag Fc is set to "1". If the rear end of the sheet passes through the nip point of the sheet transport roller pair 35, the setting of the transporting control is completely chanted from the first transporting control to the second transporting control, the sheet transporting is performed in the second transporting control.

The technical concept according to the embodiment is as follows.

(1) A recording apparatus for performing recording on a medium having a hole, including: a transporting unit which transports the medium; a recording unit which performs the recording on the transported medium; a moving unit which moves the recording unit in a direction intersecting a transport direction of the medium; a control unit which controls the transporting unit, the recording unit, and the moving unit; a first detection unit (38) which detects presence or absence of the medium at a predetermined position in a transporting path before the recording position of the recording unit; and a second detection unit (90) which is disposed to be moved together with the recording unit to detect the presence or absence of the medium, wherein an area where there is a hole excluding the two end in the transport direction of the medium is set to an invalid area where a result of the detection of the first detection unit is allowed to be invalid, wherein the control unit performs transporting control of the transporting unit based on the result of detection of the front end and end of the medium by the first detection unit, and wherein if the second detection unit detection the medium absence state in the section of the invalid area of the first detection unit, the control unit controls the transporting unit based on the result of the detection of the medium absence state by the second detection unit so that the end of the medium reaches a regulated position and so that the medium is discharged.

According to the above configuration, when the medium is in the invalid area where the hole is estimated to be at the detection position of the first detection unit, the first detection unit is allowed to be invalid, so that the erroneous detection of the hole as the end of the medium can be avoided. For example, in the case where a medium, of which the length in the transport direction is smaller than the set length is transported, although the medium is in an invalid area, if the second detection unit detects the end of the medium, the recording is allowed to stop based on the result of the detection at the time when the end reaches the regulated position, so that the medium is discharged. Therefore, the problem in that the hole is erroneously detected as the end can be solved, and although the end of the medium is in the invalid area, the recording can be stopped at a required position.

What is claimed is:

1. The recording apparatus for performing recording on a medium, comprising:

a transporting unit which transports the medium;

a recording unit which performs the recording on the transported medium;

a control unit which controls the transporting unit and the recording unit; and a detection unit which detects presence or absence of the medium at a predetermined position of the upstream side in the transport direction from a recording position of the recording unit, wherein the control unit includes a measuring unit which performs a measuring process for measuring a transporting amount of the medium in a first distance from a position where an end of the medium passes through the predetermined position to a position where the medium reaches a recording limit position where the recording of the recording unit can be performed, wherein if the detection unit detects the medium absence, a performance of the measuring process of the measuring unit is temporarily suspended, wherein if the detection unit detects the medium presence during or after transporting the medium from the time the medium absence is detected before the medium is transported for a regulated distance which is set to a value equal to or greater than a diameter of a hole provided to the medium and smaller than the first distance, a canceling process of canceling the performance of the measuring process that has been suspended is performed, and wherein if the medium is transported for the regulated distance without detection of the medium presence by the detection unit, the measuring process that has been suspended is allowed to be performed based on a value where the transporting amount of the medium during suspending of the measuring process is reflected, and wherein if the canceling process is performed, during or after transporting the medium, the control unit repeats the transporting of the medium for the regulated distance and the canceling process each time the detection unit detects the medium absence until the medium is transported for the regulated distance without detection of the medium presence by the detection unit during the transporting of the medium.

2. The recording apparatus according to claim 1, wherein if the measuring unit measures the transporting amount in the first distance and the end of the medium reaches the recording limit position, the control unit controls the recording unit and the transporting unit to forcibly finish the recording operation of the recording unit and to discharge the medium by the transporting unit.

3. The recording apparatus according to claim 1, wherein the transporting unit includes a first transport roller pair provided at the upstream side of the recording unit in the transporting direction and a second transport roller pair provided at the downstream side of the recording unit in the transporting direction, wherein a setting unit, which set the regulated distance to a value smaller than a distance from the predetermined position to the first transport roller pair, is further included, and wherein, if it is determined based on the transporting amount of the medium measured by the measuring unit that the medium is in a first section where the medium is transported by the first transport roller pair and the second transport roller pair, the control unit controls the transporting unit in a first transporting control, and if it is determined that the medium is in a second section where the medium is transported only by the second transport roller pair, the control unit controls the transporting unit in a second transporting control different from the first transporting control.

4. The recording apparatus according to claim 1, further comprising:

a medium mounting unit on which the medium is set in a stacked state;

a feeding unit which feeds the medium from the medium mounting unit; and an interval detection unit which detects that a preceding medium that is fed from the medium mounting unit is transported to a position where an interval between the preceding medium and a following medium on the medium mounting unit is a regulated amount or more, wherein if it is detected that the interval is secured to be the regulated amount or more, the control unit controls the transporting unit to feed the following medium in parallel with the preceding medium, and wherein the recording apparatus further comprises a second setting unit which sets the interval to a value larger than the regulated distance.

5. A recording apparatus for performing recording on a medium, comprising:

a transporting unit which transports and discharges the medium;

a recording unit which performs the recording on the transported medium;

a control unit which controls the transporting unit and the recording unit;

a detection unit which detects presence or absence of the medium at a predetermined position of the upstream side in the transport direction from a recording position of the recording unit; and a discharging distance acquisition unit which acquires a discharging distance necessary to discharge the medium, wherein, after the medium reaches the discharging distance during discharging the medium or after discharging the medium for the discharging distance is finished, if the detection unit detects the medium absence, the control unit performs the transporting of the medium for a regulated distance which is set to a value more than of a diameter or more of a hole provided to the medium and less than a first distance from a position where an end of the medium passes through the predetermined position to a position where the medium reaches a recording limit position where the recording of the recording unit can be performed, wherein if the detection unit detects the medium presence during the transporting of the medium for the regulated distance, the control unit performs a discharging operation of discharging the medium for a predetermined distance, wherein if the transporting of the medium for the regulated distance is finished without detection of the medium presence by the detection unit, the control unit does not perform the discharging operation, and wherein in the case where the discharging operation is performed, when the discharging operation is finished, if the detection unit detects the medium absence, the control unit repeats the transporting of the medium for the regulated distance and the discharging operation which is to be performed when the detection unit detects the medium presence during the transporting of the medium for the regulated distance until the medium is transported for the regulated distance without detection of the medium presence by the detection unit.

6. A recording apparatus for performing recording on a medium, comprising:

a transporting unit which transports the medium;

a recording unit which performs the recording on the transported medium;

a control unit which controls the transporting unit and the recording unit; and a detection unit which detects presence or absence of the medium at a predetermined position of the upstream side in the transport direction from a recording position of the recording unit, wherein the control unit includes a measuring unit which performs a measuring process for measuring a transporting amount in a first distance from a position where an end of the medium passes through the predetermined position to a position where the medium reaches a recording limit position where the recording of the recording unit can be performed, wherein, during or after the transporting of the medium, if the detection unit detects medium absence, a performance of the measuring process of the measuring unit is temporarily suspended, and the control unit performs the transporting of the medium for a regulated distance which is set to a value equal to or greater than a diameter of a hole provided to the medium and smaller than the first distance;

wherein after the transporting of the medium for the regulated distance, the control unit determines the presence or absence of the medium based on a result of the detection of the detection unit;

wherein if the medium presence is determined, the control unit performs a canceling process of canceling the performance of the measuring process that has been suspended;

wherein if the medium absence is determined, the control unit does not perform the canceling process; and wherein in the case where the canceling process is performed, during or after the transporting of the medium, the control unit repeats the transporting of the medium for the regulated distance, the determination of the presence or absence of the medium after the transporting of the medium for the regulated distance, and the canceling process each time the detection unit detects the medium absence until the result of the determination is the medium absence.

7. A transporting control method in a recording apparatus having a detection unit detecting presence or absence of a medium at a predetermined position in a transporting path, and a recording unit which performs recording on the medium provided at the downstream side of the detection unit in the transporting path, comprising:

performing transporting of the medium for a regulated distance which is set to a value equal to or greater than a diameter of a hole provided to the medium and smaller than a first distance from a position where an end of the medium passes through the predetermined position to a position where the medium reaches a recording limit position where the recording of the recording unit can be performed, during or after transporting of the medium, after the detection unit detects the medium absence:

performing a measuring process for measuring a transporting amount of the medium in the first distance;

performing a suspending process of suspending the measuring process if the detection unit detects the medium absence; and performing a canceling process if the detection unit detects the medium presence during the transporting of the medium for the regulated distance, wherein the canceling process is not performed in the case where the medium is transported for the regulated distance without detection of the medium presence by the detection unit during the transporting of the medium for the regulated distance, wherein in the case of performing the canceling process, during or after the transporting of the medium, of the medium for the regulated distance and the canceling process are repeated until the medium is transported for the regulated distance is finished without detection of the medium presence by the detection unit in the canceling process.

* * * * *